US012196469B2

(12) United States Patent
Cai et al.

(10) Patent No.: US 12,196,469 B2
(45) Date of Patent: Jan. 14, 2025

(54) LOAD BALANCING METHOD FOR TWO COMPRESSORS

(71) Applicants: York (Wuxi) Air Conditioning and Refrigeration Co., Ltd., Wuxi (CN); Johnson Controls Tyco IP Holdings LLP, Milwaukee, WI (US)

(72) Inventors: Haifeng Cai, Wuxi (CN); Xijiao Ma, Wuxi (CN); Yuqian Liu, Wuxi (CN); Chen Zhu, Wuxi (CN)

(73) Assignees: York (Wuxi) Air Conditioning and Refrigeration Co., Ltd., Jiangsu (CN); Tyco Fire & Security GmbH, Neuhausen am Rheinfall (CH)

( * ) Notice: Subject to any disclaimer, the term of this patent is extended or adjusted under 35 U.S.C. 154(b) by 235 days.

(21) Appl. No.: 17/764,952

(22) PCT Filed: Sep. 25, 2020

(86) PCT No.: PCT/CN2020/117844
§ 371 (c)(1),
(2) Date: Mar. 29, 2022

(87) PCT Pub. No.: WO2021/063266
PCT Pub. Date: Apr. 8, 2021

(65) Prior Publication Data

US 2022/0290906 A1 Sep. 15, 2022

(30) Foreign Application Priority Data

Sep. 30, 2019 (CN) ..... 201910939939.7

(51) Int. Cl.
*F25B 49/02* (2006.01)
*F25B 7/00* (2006.01)

(52) U.S. Cl.
CPC ..... *F25B 49/022* (2013.01); *F25B 7/00* (2013.01); *F25B 2400/075* (2013.01);
(Continued)

(58) Field of Classification Search
CPC .... F25B 49/022; F25B 7/00; F25B 2400/075; F25B 2500/19; F25B 2600/2501;
(Continued)

(56) References Cited

U.S. PATENT DOCUMENTS 3,648,479 A * 3/1972 Richardson ..... F04D 27/0269 62/217
2005/0160749 A1* 7/2005 Shaffer ..... F04D 27/0246 62/228.4

(Continued)

FOREIGN PATENT DOCUMENTS

CN 1510361 A 7/2004
CN 101017039 A 8/2007

(Continued)

OTHER PUBLICATIONS

European Search Report for EP Application No. 20871878.3, dated Sep. 20, 2023, 8 pages.

(Continued)

*Primary Examiner* — Larry L Furdge
(74) *Attorney, Agent, or Firm* — Fletcher Yoder, P.C.

(57) ABSTRACT

A load balancing method for two compressors. The two compressors are used in a refrigeration system and are driven coaxially by the same driving device. The method comprises the steps of obtaining parameters, determining balance, and controlling start/stop states. The parameters in the step of obtaining parameters are parameters related to the two compressors. The step of determining balance comprises determining, on the basis of the obtained parameters related to the two compressors, whether load is balanced (Continued)

between the two compressors. The step of controlling start/top states comprises controlling the start/stop states of the two compressors according to whether the load is balanced.

15 Claims, 10 Drawing Sheets

(52) U.S. Cl.
CPC ... *F25B 2500/19* (2013.01); *F25B 2600/2501* (2013.01); *F25B 2700/1933* (2013.01); *F25B 2700/21151* (2013.01); *F25B 2700/21152* (2013.01)

(58) Field of Classification Search
CPC .... F25B 2700/1933; F25B 2700/21151; F25B 2700/21152

See application file for complete search history.

(56) References Cited

U.S. PATENT DOCUMENTS

| | | | | |
|---|---|---|---|---|
| 2016/0265815 | A1* | 9/2016 | Snell | F25B 31/004 |
| 2017/0089598 | A1 | 3/2017 | Wallace et al. | |
| 2019/0226738 | A1 | 7/2019 | Forristall et al. | |

FOREIGN PATENT DOCUMENTS

| | | | |
|---|---|---|---|
| CN | 104457030 | A | 3/2015 |
| CN | 204648757 | U | 9/2015 |
| CN | 107144040 | A | 9/2017 |
| CN | 109312752 | A | 2/2019 |
| JP | S597788 | A | 1/1984 |
| JP | 2005345083 | A | 12/2005 |
| WO | 8202587 | A1 | 8/1982 |

OTHER PUBLICATIONS

PCT International Search Report for PCT Application No. PCT/CN2020/117844, mailed Dec. 21, 2020, 5 pgs.

* cited by examiner

LOAD BALANCING METHOD FOR TWO COMPRESSORS

CROSS-REFERENCE TO RELATED APPLICATIONS

This application is a U.S. National Stage Application of PCT Application No. BALANCING METHOD FOR TWO PCT/CN2020/117844, entitled "LOAD COMPRESSORS," filed Sep. 25, 2020, which claims priority to and the benefit of Chinese Patent Application No. 201910939939.7, filed Sep. 30, 2019, each of which is herein incorporated by reference in its entirety for all purposes.

FIELD OF THE INVENTION

The present application relates to the technical field of refrigeration systems, and more particularly, to a load balancing method for two compressors.

DESCRIPTION OF THE RELATED ART

A refrigeration system typically makes use of external energy to transfer heat from a substance (or environment) of a lower temperature to a substance (or environment) of a higher temperature. Compressors are key equipment in a refrigeration system, which are often used to compress a gas of a lower pressure to a gas of a higher pressure, such that the volume of the gas is reduced, and the pressure thereof is increased, thereby converting the external mechanical energy into a pressure energy of the gas. When two compressors are used together in a refrigeration system, it is necessary to maintain load balance between the two compressors to ensure the normal operation of the refrigeration system.

SUMMARY OF THE INVENTION

For a refrigeration system that uses two driving devices to respectively drive two compressors, whether there is load balance between the two compressors can be directly determined by monitoring whether the two driving devices have the same rotational speed. When two compressors in a refrigeration system are driven coaxially by one driving device, the structural setting of coaxial driving keeps rotational speeds of the two compressors to be constantly the same. As a result, it is impossible to determine whether there is load balance between these two compressors by directly monitoring rotational speeds. The present application provides a load balancing method for two coaxially driven compressors, which can effectively monitor the load balancing states of the two coaxially driven compressors, thereby preventing the compressors from being damaged by unbalanced loads of the compressors.

The present application provides a load balancing method for two compressors. The two compressors are used in a refrigeration system, comprising a first compressor and a second compressor, wherein the first compressor and the second compressor are driven coaxially by the same driving device, suction sides of the first compressor and the second compressor are both connected with the same evaporator via a pipeline, and exhaust sides of the first compressor and the second compressor are both connected with the same condenser via a pipeline, characterized in that the method comprises the steps of obtaining parameters, determining balance, and controlling start/stop states. Here, the parameters in the step of obtaining parameters are parameters related to the first compressor and the second compressor, the step of determining balance comprises determining whether a balance is achieved between the first compressor and the second compressor according to the obtained parameters related to the first compressor and the second compressor, and the step of controlling start/stop states comprises controlling start/stop states of the first compressor and the second compressor according to whether the balance is achieved.

In the method described above, the suction side of the first compressor and the suction side of the second compressor are respectively provided with a pre-rotation guide vane, the pre-rotation guide vanes are used for regulating the flow rate of a refrigerant flowing into the first compressor and the second compressor, and the imbalance between the first compressor and the second compressor is caused by the pre-rotation guide vanes.

The method described above further comprises obtaining an operating mode, wherein operating modes of the first compressor and the second compressor are obtained according to current load demands of the first compressor and the second compressor, the operating modes comprise a hot gas bypass operating mode, a speed operating mode, and a PRV operating mode, and when the first compressor and the second compressor are running in the speed operating mode and the PRV operating mode, the steps of determining balance and controlling start/stop states are carried out.

In the method described above, the step of obtaining parameters comprises: obtaining the flow rate $Q_A$ at the suction side of the first compressor and the flow rate $Q_B$ at the suction side of the second compressor; or obtaining the flow rate $Q_C$ at the exhaust side of the first compressor and the flow rate $Q_D$ at the exhaust side of the second compressor; and the step of determining balance comprises: obtaining a flow rate deviation value $\delta Q$ according to the flow rate $Q_A$ and the flow rate $Q_B$ or according to the flow rate $Q_C$ and the flow rate $Q_D$.

In the method described above, the step of obtaining balance further comprises: when the first compressor and the second compressor are running in the PRV operating mode, determining whether the flow rate deviation value $\delta Q$ is greater than or equal to a first preset value, and if yes, preliminarily determining that the first compressor and the second compressor are in an unbalanced state.

In the method described above, the step of obtaining balance further comprises: after preliminarily determining that the first compressor and the second compressor are in an unbalanced state, continuously monitoring the flow rate $Q_A$ and the flow rate $Q_B$ or monitoring the flow rate $Q_C$ and the flow rate $Q_D$ within a first preset time, determining whether the flow rate deviation $\delta Q$ is always greater than or equal to the first preset value according to the monitored flow rate $Q_A$ and flow rate $Q_B$ or the monitored flow rate $Q_C$ and flow rate $Q_D$, and if yes, determining that the first compressor and the second compressor are in an unbalanced state.

The method described above further comprises adjusting the compressors, wherein the step of adjusting the compressors comprises adjusting the opening degree of the pre-rotation guide vanes, and the step of adjusting the compressors is carried out after determining that the first compressor and the second compressor are in an unbalanced state; the step of controlling start/stop states comprises: waiting for a second preset time after the step of adjusting the compressors, re-obtaining the flow rate $Q_A$ and the flow rate $Q_B$ or re-obtaining the flow rate $Q_C$ and the flow rate $Q_D$ after the second preset time elapses, and determining the adjusted flow rate deviation value $\delta Q$ according to the flow rate $Q_A$ and the flow rate $Q_B$ or according to the flow rate $Q_C$ and the flow rate $Q_D$; determining whether the flow rate deviation value $\delta Q$ is greater than or equal to a second preset value, and if yes, shutting down, wherein the second preset value is greater than the first preset value.

In the method described above, the step of determining balance further comprises: when the first compressor and the second compressor are running in the speed operating mode, determining whether the flow rate deviation $\delta Q$ is greater than or equal to a third preset value, and if yes, determining that the first compressor and the second compressor are in an unbalanced state; and the step of controlling start/stop states comprises: after determining that the first compressor and the second compressor are in an unbalanced state, obtaining a shutdown time according to the flow rate deviation $\delta Q$, and shutting down when the shutdown time elapses.

In the method described above, the step of determining balance further comprises: the flow rate $Q_A$ at the suction side of the first compressor is measured on a bypass pipeline at one side of the main pipeline between the first compressor and the evaporator, and the flow rate $Q_B$ at the suction side of the second compressor is measured on a bypass pipeline at one side of the main pipeline between the second compressor and the evaporator; the flow rate $Q_C$ at the exhaust side of the first compressor is measured on a bypass pipeline at one side of the main pipeline between the first compressor and the condenser, and the flow rate $Q_D$ at the exhaust side of the second compressor is measured on a bypass pipeline at one side of the main pipeline between the second compressor and the condenser.

In the method described above, the flow rate deviation value $\delta Q=2|Q_A-Q_B|/(Q_A+Q_B)$, or the flow rate deviation value $\delta Q=2|Q_C-Q_D|/(Q_C+Q_D)$.

In the method described above, the step of obtaining parameters comprises: obtaining the temperature $T_A$ at the suction side of the first compressor and the temperature $T_B$ at the suction side of the second compressor; and the step of determining balance comprises: determining whether the temperature $T_A$ at the suction side of the first compressor or the temperature $T_B$ at the suction side of the second compressor is greater than a first preset temperature, and if yes, carrying out the step of controlling start/stop states to shut down the first compressor and the second compressor.

In the method described above, the top of the evaporator and the top of the condenser are in communication with each other through a hot gas bypass pipeline, and a hot gas bypass valve is provided in the hot gas bypass pipeline; the step of determining balance further comprises: after determining that neither the temperature $T_A$ at the suction side of the first compressor nor the temperature $T_B$ at the suction side of the second compressor is greater than the first preset temperature, obtaining the degree of superheat $\Delta T_A$ at the suction side of the first compressor and the degree of superheat $\Delta T_B$ at the suction side of the second compressor; determining whether the degree of superheat $\Delta T_A$ at the suction side of the first compressor or the degree of superheat $\Delta T_B$ at the suction side of the second compressor is greater than a second preset temperature, and if yes, determining whether the hot gas bypass valve is open; if determining that the hot gas bypass valve is open, determining whether it is the degree of superheat $\Delta T_A$ at the suction side of the first compressor or the degree of superheat $\Delta T_B$ at the suction side of the second compressor that is greater than the second preset temperature; if it is the degree of superheat $\Delta T_A$ at the suction side of the first compressor that is greater than the second preset temperature, obtaining the degree of superheat $\Delta T_C$ at the exhaust side of the first compressor, and determining whether the degree of superheat $\Delta T_C$ at the exhaust side of the first compressor is lower than a third preset temperature; if yes, carrying out the step of controlling start/stop states to shut down the first compressor and the second compressor; if it is the degree of superheat $\Delta T_B$ at the suction side of the second compressor that is greater than the second preset temperature, obtaining the degree of superheat $\Delta T_D$ at the exhaust side of the second compressor, and determining whether the degree of superheat $\Delta T_D$ at the exhaust side of the second compressor is lower than the third preset temperature; if yes, carrying out the step of controlling start/stop states to shut down the first compressor and the second compressor; if determining that the hot gas bypass valve is closed, carrying out the step of controlling start/stop states to shut down the first compressor and the second compressor.

In the method described above, the step of determining balance further comprises: determining whether the rotational speeds of the first compressor and the second compressor are greater than a predetermined rotational speed, and carrying out, only when the determination result is yes, the step of determining whether the temperature $T_A$ at the suction side of the first compressor or the temperature $T_B$ at the suction side of the second compressor is greater than the first preset temperature.

In the method described above, the degree of superheat $\Delta T_A$ at the suction side of the first compressor is a temperature difference between the temperature at the suction side of the first compressor and the saturation temperature of the evaporator; and the degree of superheat $\Delta T_B$ at the suction side of the second compressor is a temperature difference between the temperature at the suction side of the second compressor and the saturation temperature of the evaporator.

In the method described above, the degree of superheat $\Delta T_C$ at the exhaust side of the first compressor is a temperature difference between the temperature at the exhaust side of the first compressor and the saturation temperature at the exhaust side of the first compressor; and the degree of superheat $\Delta T_D$ at the suction side of the second compressor is a temperature difference between the temperature at the exhaust side of the second compressor and the saturation temperature at the exhaust side of the second compressor.

The present application creatively adopts three different manners, i.e., exhaust flow rate monitoring, suction flow rate monitoring, and suction temperature monitoring, to monitor load balance of two compressors that are coaxially driven, which can effectively avoid failure of a refrigeration system caused by unbalanced loads of the compressors. In addition, the three load balance monitoring methods adopted by the present application, i.e., exhaust flow rate monitoring, suction flow rate monitoring, and suction temperature monitoring, can also be combined for use in the same monitoring system.

DETAILED DESCRIPTION OF THE INVENTION

Various implementation manners of the present application will be described below with reference to the accompanying drawings that form a part of this description.

Figure 1:
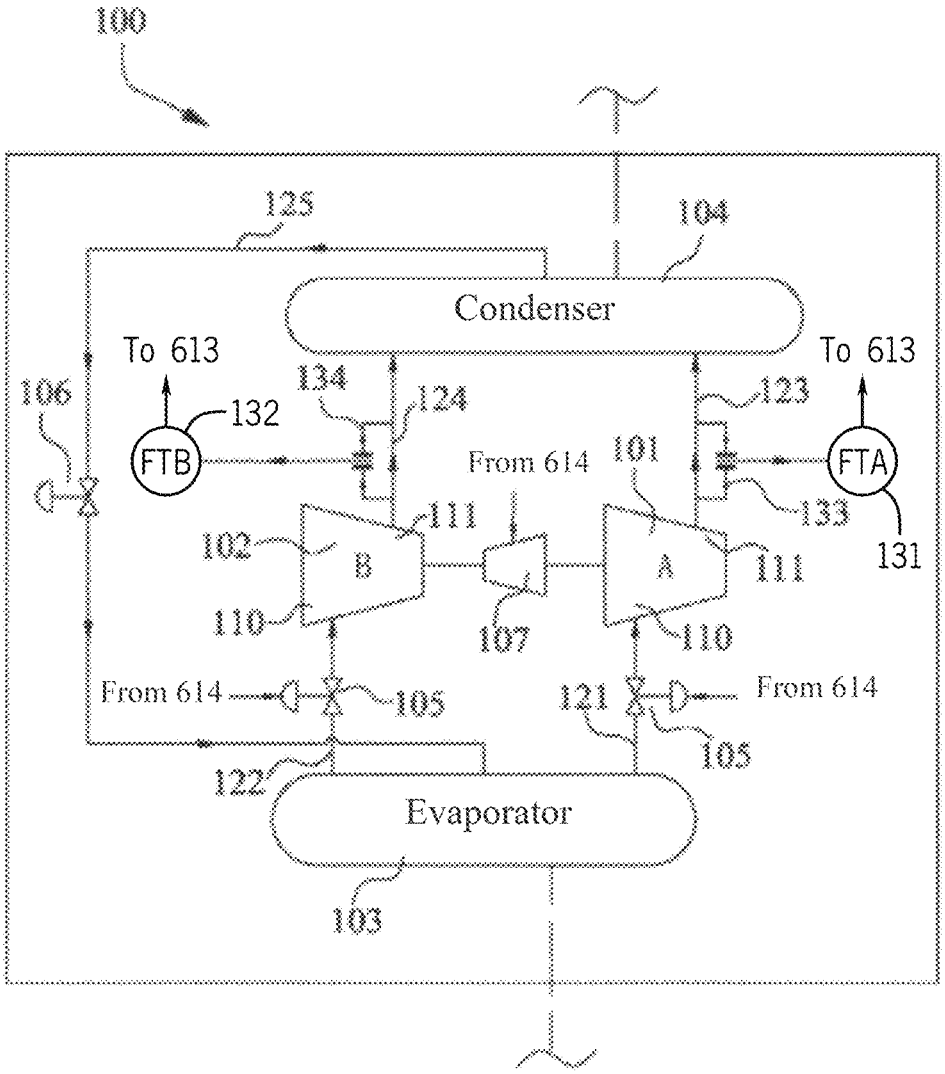
FIG. 1 illustrates a load balance monitoring system 100 of coaxial compressors according to a first embodiment of the present application.

FIG. 1 illustrates a load balance monitoring system 100 of coaxial compressors according to a first embodiment of the present application. As shown in FIG. 1, the load balance monitoring system 100 is applied in a refrigeration system. For ease of illustration, only part of parts in the refrigeration system are shown in FIG. 1, including an evaporator 103, a condenser 104, a driving device 107, and two compressors. The two compressors are a first compressor 101 and a second compressor 102, respectively, and the first compressor 101 and the second compressor 102 are coaxially driven by the driving device 107 and arranged side by side between the evaporator 103 and the condenser 104. In embodiments of the present application, the driving device 107 is a dual extension shaft steam turbine, while other driving devices may also be used in other embodiments, such as dual extension shaft motors, as long as two compressors can be driven to rotate coaxially. In the embodiments of the present application, the first compressor 101 and the second compressor 102 are both centrifugal compressors, which may also be other types of compressors in other embodiments.

The suction side 110 of the first compressor 101 is connected with the evaporator 103 via a first suction pipeline 121, the suction side 110 of the second compressor 102 is connected with the evaporator 103 via a second suction pipeline 122, the exhaust side 111 of the first compressor 101 is connected with the condenser 104 via a first exhaust pipeline 123, and the exhaust side 111 of the second compressor 102 is connected with the condenser 104 via a second exhaust pipeline 124. The above-described arrangement enables a refrigerant from the evaporator 103 to simultaneously enter the first compressor 101 and the second compressor 102, and after being compressed by the first compressor 101 and the second compressor 102, to be simultaneously discharged to the condenser 104. The suction sides 110 of both the first compressor 101 and the second compressor 102 are respectively provided with a pre-rotation vane (PRV) 105, and by adjusting the opening degrees of the two pre-rotation vanes (PRV) 105, the flow rates of the refrigerant into the first compressor 101 and the second compressor 102 can be respectively controlled. The two pre-rotation vanes (PRV) 105 in the present embodiment are respectively arranged inside the first compressor 101 and the second compressor 102, but for ease of description and illustration, the two pre-rotation vanes (PRV) are illustrated to be independent of the first compressor 101 and the second compressor 102 in the accompanying drawings of the present application. In addition, a hot gas bypass pipeline 125 is further provided between the top of the evaporator 103 and the top of the condenser 104, and a hot gas bypass valve 106 is provided on the hot gas bypass pipeline 125 for adjusting the capacity balance of the refrigeration system.

The load balance monitoring system 100 determines whether there is load balance between the first compressor 101 and the second compressor 102 by monitoring the flow rates at the exhaust sides of the first compressor 101 and the second compressor 102. To realize the monitoring of the flow rates at the exhaust sides 111 of the first compressor 101 and the second compressor 102, the load balance monitoring system 100 provides a first exhaust flow sensor 131 and a second exhaust flow sensor 132 at the exhaust sides 111 of the first compressor 101 and the second compressor 102, respectively. To reduce the impact of the flow sensors on the normal flow of the fluid in the main pipeline of the exhaust pipelines, a bypass pipeline for communicating with a sensor is provided at a side of each of the first exhaust pipeline 123 and the second exhaust pipeline 124 in the embodiments of the present application, wherein the bypass pipeline at the side of the first exhaust pipeline 123 is the first exhaust branch 133, and the first exhaust flow sensor 131 is arranged in the first exhaust branch 133; the bypass pipeline at the side of the second exhaust pipeline 124 is the second exhaust branch 134, and the second exhaust flow sensor 132 is arranged in the second exhaust branch 134. Since the first exhaust branch 133 is in communication with the first exhaust pipeline 123 in a parallel manner and the second exhaust branch 134 is in communication with the second exhaust pipeline 124 in a parallel manner, the difference between the exhaust flow rates of the first exhaust branch 133 and the second exhaust branch 134 can reflect the difference between the exhaust flow rates of the first exhaust pipeline 123 and the second exhaust pipeline 124.

Figure 2:
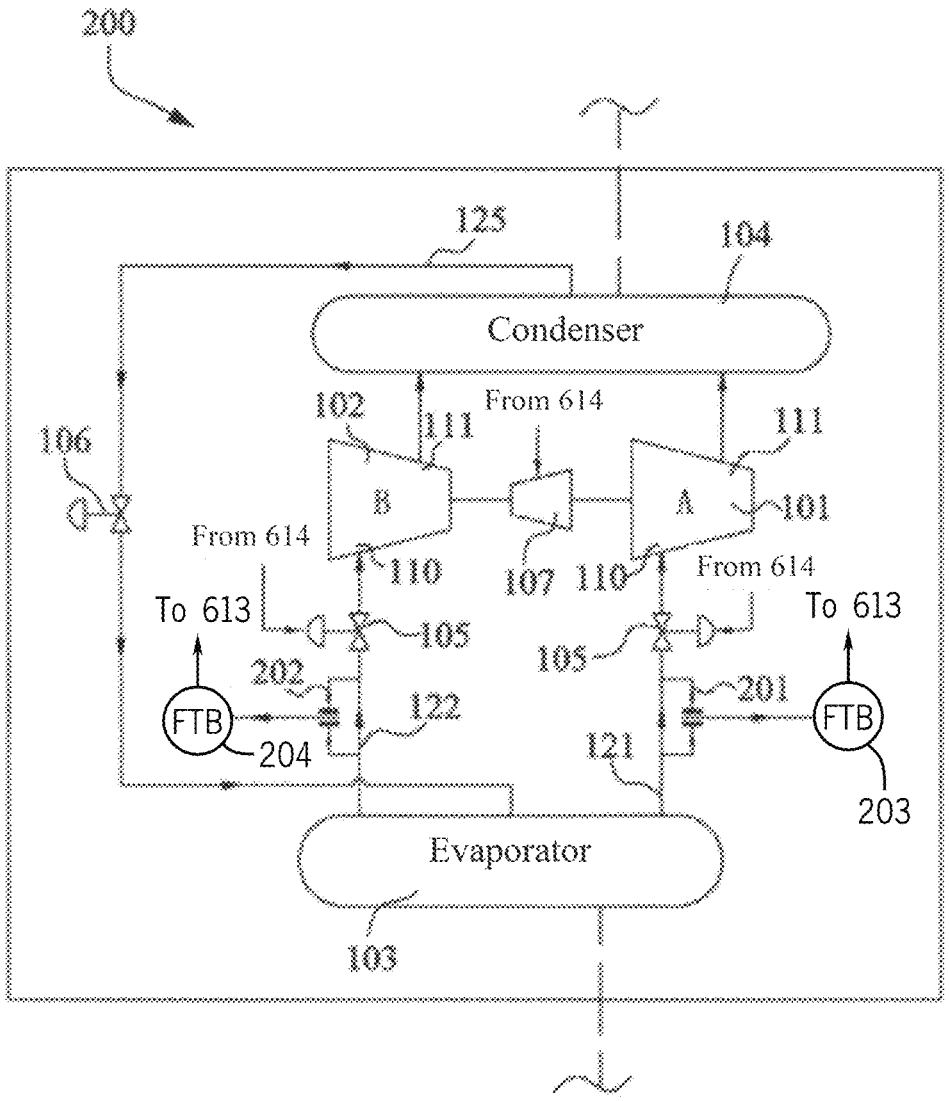
FIG. 2 illustrates a load balance monitoring system 200 of coaxial compressors according to a second embodiment of the present application.

FIG. 2 illustrates a load balance monitoring system 200 of coaxial compressors according to a second embodiment of the present application. As shown in FIG. 2, the environment of the refrigeration system in which the load balance monitoring system 200 according to the second embodiment is applied is the same as the environment of the refrigeration system in which the load balance monitoring system 100 according to the first embodiment is applied, where the first compressor 101 and the second compressor 102 are coaxially driven by the driving device 107 and arranged side by side between the evaporator 103 and the condenser 104, and in addition, the top of the condenser 104 and the top of the evaporator 103 are connected by means of a hot gas bypass pipeline 125 provided with a hot gas bypass valve 106. Unlike the load balance monitoring system 100 according to the first embodiment in which flow sensors are provided at the exhaust sides 111 of the compressors, flow sensors are provided at the suction sides 110 of the first compressor 101 and the second compressor 102 in the load balance monitoring system 200 according to the second embodiment, so as to determine whether there is load balance between the two compressors by monitoring the flow rates at the suction sides 110 of the compressors. As shown in FIG. 2, a first suction branch 201 is provided at a side of the first suction pipeline 121, and a first suction flow sensor 203 is arranged on the first suction branch 201; a second suction branch 202 is provided at a side of the second suction pipeline 122, and a second suction flow sensor 204 is arranged on the second suction branch 202. The load balance monitoring system 200 reflects the difference between the flow rates at the suction sides 110 of the first compressor 101 and the second compressor 102 through the flow rate difference obtained from monitoring the flow rates of the first suction branch 201 and the second suction branch 202.

Figure 3:
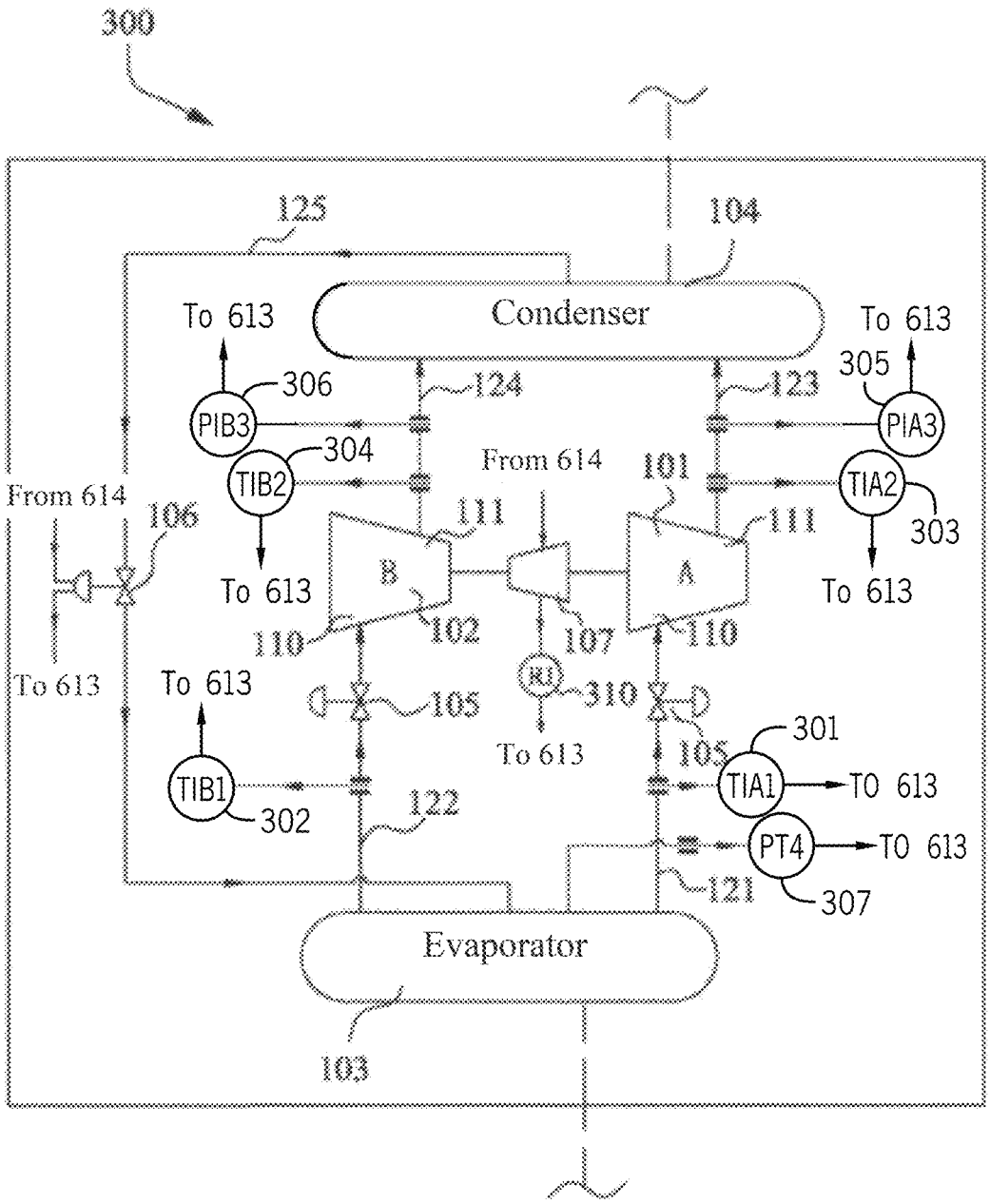
FIG. 3 illustrates a load balance monitoring system 300 of coaxial compressors according to a third embodiment of the present application.

FIG. 3 illustrates a load balance monitoring system 300 of coaxial compressors according to a third embodiment of the present application. As shown in FIG. 3, the environment of the refrigeration system in which the load balance monitoring system 300 according to the third embodiment is applied is also the same as the environment of the refrigeration system in which the load balance monitoring system 100 according to the first embodiment is applied, where the first compressor 101 and the second compressor 102 are coaxially driven by the driving device 107 and arranged side by side between the evaporator 103 and the condenser 104, and in addition, the top of the condenser and the top of the evaporator are connected by means of a hot gas bypass pipeline 125 provided with a hot gas bypass valve 106. Unlike the first embodiment and the second embodiment in which flow sensors are provided at the exhaust sides 111 or the suction sides 110 of the compressors, temperature sensors are provided at the suction sides 110 of the compressors, temperature sensors and pressure sensors are provided at the exhaust sides 111 of the compressors, and a pressure sensor is provided at the evaporator 103 in the load balance monitoring system 300 according to the third embodiment, so as to determine whether there is load balance between the two compressors by monitoring the degrees of superheat at the suction sides 110 and the degrees of superheat at the exhaust sides 111 of the compressors. As shown in FIG. 3, a first suction temperature sensor 301 is provided on the first suction pipeline 121, a second suction temperature sensor 302 is provided on the second suction pipeline 122, a first exhaust temperature sensor 303 and a first exhaust pressure sensor 305 are provided on the first exhaust pipeline 123, a second exhaust temperature sensor 304 and a second exhaust pressure sensor 306 are provided on the second exhaust pipeline 124, and a suction pressure sensor 307 is provided at the top of the evaporator 103. In addition, a rotational speed sensor 310 is further provided on the driving device 107 in the load balance monitoring system 300, which is used for detecting the rotational speed of the driving device 107.

Figure 4:
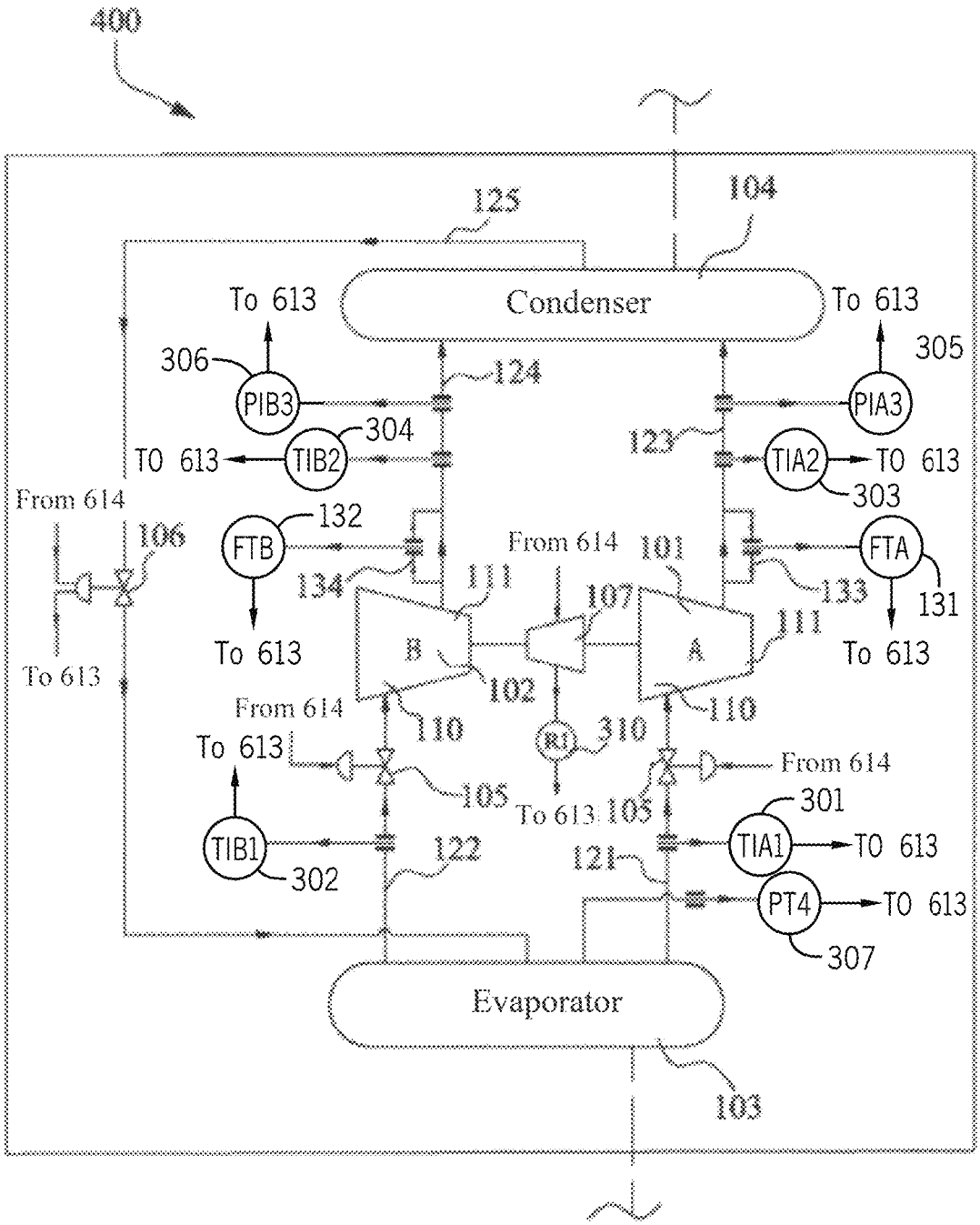
FIG. 4 illustrates a load balance monitoring system 400 of coaxial compressors according to a fourth embodiment of the present application.

FIG. 4 illustrates a load balance monitoring system 400 of coaxial compressors according to a fourth embodiment of the present application. As shown in FIG. 4, the environment of the refrigeration system in which the load balance monitoring system 400 according to the fourth embodiment is applied is the same as the environment of the refrigeration system in which the load balance monitoring system 300 according to the third embodiment is applied. In addition, the following of the load balance monitoring system 400 according to the fourth embodiment are also the same as those in the load balance monitoring system 300 according to the third embodiment: a first suction temperature sensor 301 is provided at the suction side 110 of the first compressor 101, a second suction temperature sensor 302 is provided at the suction side 110 of the second compressor 102, a first exhaust temperature sensor 303 and a first exhaust pressure sensor 305 are provided at the exhaust side 111 of the first compressor 101, a second exhaust temperature sensor 304 and a second exhaust pressure sensor 306 are provided at the exhaust side 111 of the second compressor 102, a suction pressure sensor 307 is provided at the top of the evaporator 103, and a rotational speed sensor 310 is provided on the driving device 107, so as to determine whether there is load balance between the two compressors by monitoring the degrees of superheat at the suction sides 110 and the degrees of superheat at the exhaust sides 111 of the compressors. On the basis of the load balance monitoring system 300 according to the third embodiment, flow sensors are further provided at the exhaust sides 111 of the compressors in the load balance monitoring system 400 according to the fourth embodiment, which is the same as the load balance monitoring system 100 according to the first embodiment as shown in FIG. 1, such that whether there is load balance between the two compressors can be determined by monitoring the flow rates at the exhaust sides of the compressors, just like the load balance monitoring system 100. As shown in FIG. 4, the first exhaust flow sensor 131 is arranged on the first exhaust branch 133 at the side of the first exhaust pipeline 123, and the second exhaust flow sensor 132 is arranged on the second exhaust branch 134 at the side of the second exhaust pipeline 124. In other words, the load balance monitoring system 400 according to the fourth embodiment has the monitoring equipment in both the load balance monitoring system 300 according to the third embodiment and the load balance monitoring system 100 according to the first embodiment, and can simultaneously realize the load balance monitoring functions of the load balance monitoring system 300 and the load balance monitoring system 100.

Figure 5:
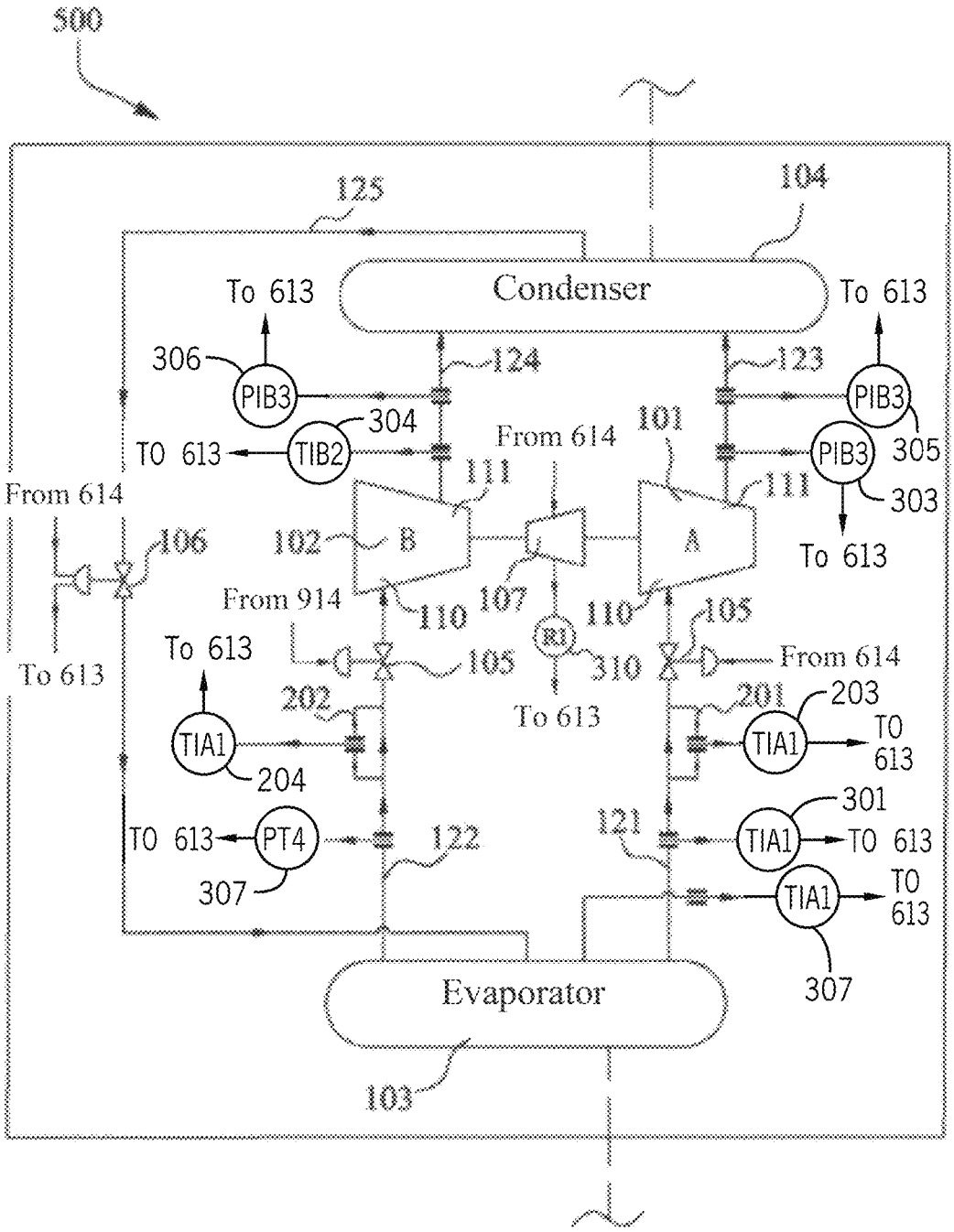
FIG. 5 illustrates a load balance monitoring system 500 of coaxial compressors according to a fifth embodiment of the present application.

FIG. 5 illustrates a load balance monitoring system 500 of coaxial compressors according to a fifth embodiment of the present application. As shown in FIG. 5, the environment of the refrigeration system in which the load balance monitoring system 500 according to the fifth embodiment is applied is the same as the environment of the refrigeration system in which the load balance monitoring system 300 according to the third embodiment is applied. In addition, the following of the load balance monitoring system 500 according to the fifth embodiment are also the same as those in the load balance monitoring system 300 according to the third embodiment: a first suction temperature sensor 301 is provided at the suction side 110 of the first compressor 101, a second suction temperature sensor 302 is provided at the suction side 110 of the second compressor 102, a first exhaust temperature sensor 303 and a first exhaust pressure sensor 305 are provided at the exhaust side 111 of the first compressor 101, a second exhaust temperature sensor 304 and a second exhaust pressure sensor 306 are provided at the exhaust side 111 of the second compressor 102, a suction pressure sensor 307 is provided at the top of the evaporator 103, and a rotational speed sensor 310 is provided on the driving device 107, so as to determine whether there is load balance between the two compressors by monitoring the degrees of superheat at the suction sides 110 and the degrees of superheat at the exhaust sides 111 of the compressors. On the basis of the load balance monitoring system 300 according to the third embodiment, flow sensors are further provided at the suction sides 110 of the compressors in the load balance monitoring system 500 according to the fifth embodiment, which is the same as the load balance monitoring system 200 according to the second embodiment as shown in FIG. 2, such that whether there is load balance between the two compressors can be determined by monitoring the flow rates at the suction sides 110 of the compressors, just like the load balance monitoring system 200.

As shown in FIG. 5, the first suction flow sensor 203 is arranged on the first suction branch 201 at the side of the first suction pipeline 121, and the second suction flow sensor 204 is arranged on the second suction branch 202 at the side of the second suction pipeline 122. In other words, the load balance monitoring system 500 according to the fifth embodiment has the monitoring equipment in both the load balance monitoring system 300 according to the third embodiment and the load balance monitoring system 200 according to the second embodiment, and can simultaneously realize the load balance monitoring functions of the load balance monitoring system 300 and the load balance monitoring system 200.

Since the main pipelines of the suction pipelines and the exhaust pipelines have relatively large diameters, the installation of a large flow sensor will impact the suction or exhaust pressure drop, and the installation cost will be high. To prevent a flow sensor from impacting the flow of a refrigerant on the main pipelines and to lower the cost, flow sensors in the load balance monitoring systems according to the first embodiment, the second embodiment, the fourth embodiment, and the fifth embodiment are all provided on bypass pipelines added to one side of the main pipelines. The bypass pipelines are flow pipelines have small diameters and are arranged side by side with the main pipelines that have gas flow rates to be measured. The installation of flow sensors on the bypass pipelines having small diameters not only can detect a difference in flow rates at the suction or exhaust sides of the compressors, but also can minimize the pressure drop on the suction or exhaust pipelines, and in addition, the cost is low. In other embodiments, flow sensors may also be directly provided on the main pipeline of an exhaust pipeline or a suction pipeline if the impact caused by the above-described factors is not considered.

Figure 6:
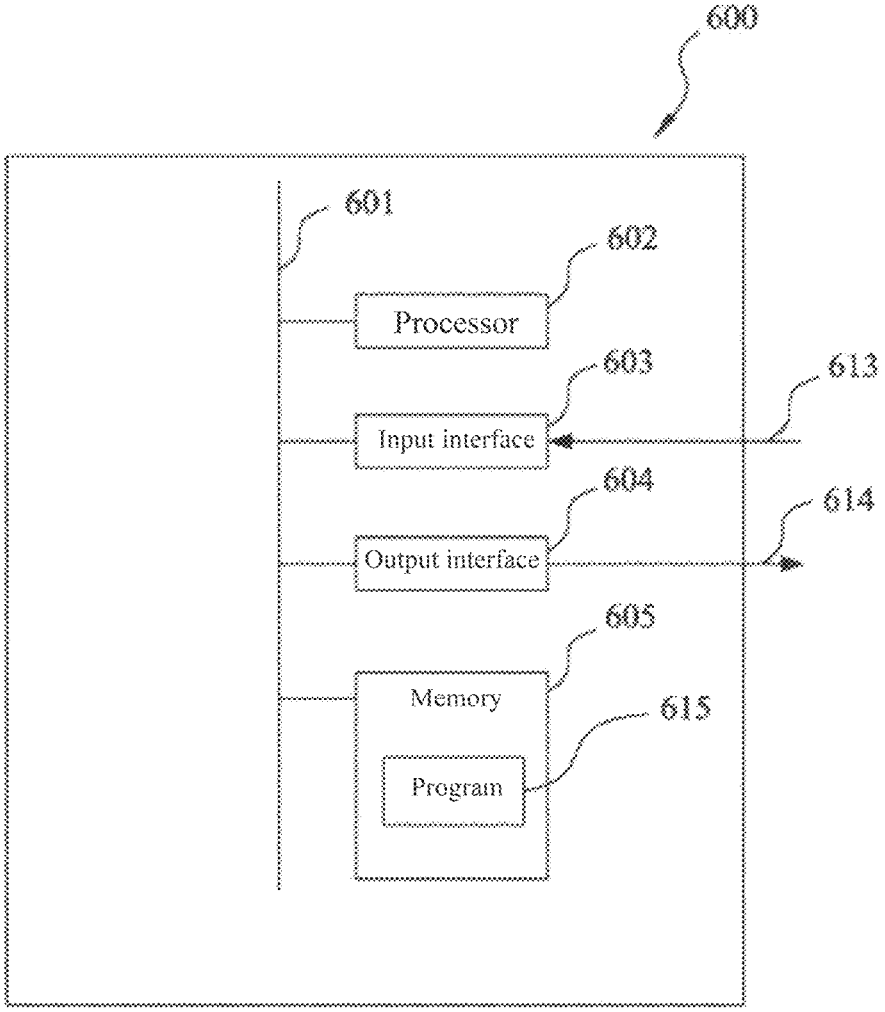
FIG. 6 illustrates a control device 600 used by the load balance monitoring systems shown in FIGS. 1-5.

FIG. 6 illustrates a control device 600 used by the load balance monitoring systems shown in FIGS. 1-5. The control device 600 is communicatively connected with a corresponding load balance monitoring system thereof and can receive a signal from the load balance monitoring system, process the received signal, and carry out the control of the load balance monitoring system according to a result of the processing. As shown in FIG. 6, the control device 600 comprises a bus 601, a processor 602, an input interface 603, an output interface 604, and a memory 605. All the components in the control device 600, including the processor 602, the input interface 603, the output interface 604, and the memory 605, are all communicatively connected with the bus 601, which enables the processor 602 to control, via the bus 601, operations of the input interface 603, the output interface 604, and the memory 605. The memory 605 is used for storing a program 615, the input interface 603 can receive the signal from the load balance monitoring system via an input line 613, and the output interface 604 can output a control signal to the load balance monitoring system via an output line 614. The processor 602 can read the program 615 stored in the memory 605, and can run the program 615. The processor 602 can call different programs 615 according to different load balance monitoring systems, so as to execute different control logics. In the process of running a program, the processor 602 can read, from the input interface 603, a signal received thereby, process the read signal, and carry out the control of a load balance monitoring system according to a result of the processing.

To ensure load balance between two coaxially driven compressors, it is required to simultaneously ensure that the opening degrees of pre-rotation guide vanes (PRV) of the compressors are consistent in command outputs, and the actual opening degrees of the pre-rotation guide vanes (PRV) controlled by actuators are consistent with the received opening degree commands. However, when a transmission failure occurs between an actuator and a pre-rotation guide vane, or when a pre-rotation guide vane fails itself, the two coaxially driven compressors will consequently have unbalanced loads. When the failure is serious, one of the compressors in the refrigeration system cannot operate normally. At this point, the two compressors have very different loads, and the exhaust from the normally operating compressor interferes with the compressor that operates abnormally. Here, the exhaust from the normally operating compressor flows backward, via a condenser, to the compressor that has stopped operations or operates with a failure, and in serious cases, the overall temperature of the compressor that has stopped operations or operates with a failure increases, leading to damage to the compressor that operates abnormally. To avoid damage to a compressor due to unbalanced loads of two coaxially driven compressors, the inventors of the present application have invented three different monitoring manners, i.e., exhaust flow rate monitoring, suction flow rate monitoring, and suction temperature monitoring, and the adoption of any one thereof can effectively determine whether two compressors that are coaxially driven are in a balanced loading state. In addition, on the basis of the three monitoring manners, i.e., exhaust flow rate monitoring, suction flow rate monitoring, and suction temperature monitoring, the present application can adopt a manner that combines the exhaust flow rate monitoring and the suction temperature monitoring or adopt a manner that combines the suction flow rate monitoring and the suction temperature monitoring, which can also determine whether there is load balance between two compressors that are coaxially driven.

Figure 7A:
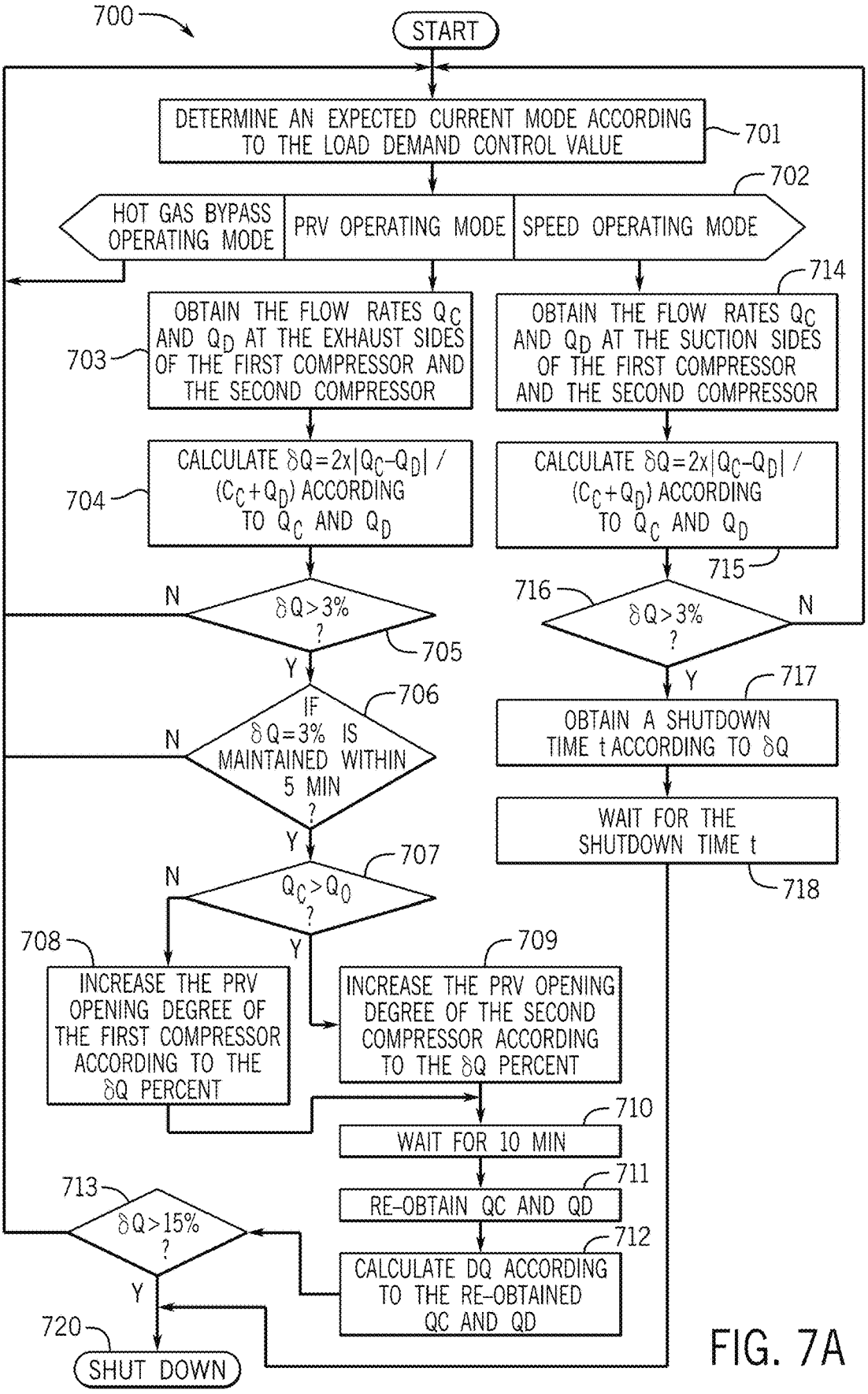
FIG. 7A illustrates a control logic 700 that adopts the load balance monitoring system 100 shown in FIG. 1 to monitor whether two coaxial compressors have balanced loads.

FIG. 7A illustrates a control logic 700 that adopts the load balance monitoring system 100 according to the first embodiment as shown in FIG. 1 to monitor whether two coaxial compressors have balanced loads. When the load balance monitoring system 100 operates, the first exhaust flow sensor 131 and the second exhaust flow sensor 132 shown in FIG. 1 continuously monitor the gas flow rate $Q_C$ at the exhaust side 111 of the first compressor 101 and the gas flow rate $Q_D$ at the exhaust side 111 of the second compressor 102, the measured gas flow rate data is transmitted, via the input line 613, to the input interface 603 in the control device 600. Such system setting enables the load balance monitoring system 100 to determine whether the first compressor 101 and the second compressor 102 are balanced by monitoring the flow rates of the refrigerant at the exhaust sides 111 of these two compressors.

As shown in FIG. 7A, the control logic 700 of the load balance monitoring system 100 starts and then enters step 701. In step 701, the control device 600 determines an expected current mode according to the load demand control value of the refrigeration system. The refrigeration system in which the load balance monitoring system of the present application is applied has a total of three operating modes during operations, which are a hot gas bypass operating mode, a PRV operating mode, and a speed operating mode, respectively. The operating mode of the refrigeration system is continuously adjusted according to current refrigeration load demand of the refrigeration system, that is, it is certain that the refrigeration system has an expected current mode corresponding to the current load demand at any moment. When in the hot gas bypass operating mode, the hot gas bypass valve 106 of the refrigeration system is in an open state, the top of the evaporator 103 and the top of the condenser 104 are in communication with each other through the hot gas bypass pipeline 125. When the refrigeration system is in the PRV operating mode or the speed operating mode, the hot gas bypass valve 106 is in the closed state, and the evaporator 103 and the condenser 104 cannot be in direct communication with each other through the hot gas bypass pipeline 125. When the refrigeration system is in the PRV operating mode, the opening degrees of the pre-rotation vanes (PRV) 105 of the first compressor 101 and the second compressor 102 are in a dynamic adjustment state, such that the gas intake constantly changes for the first compressor 101 and the second compressor 102. When the refrigeration system is in the speed operating mode, the opening degrees of the pre-rotation vanes (PRV) 105 of the first compressor 101 and the second compressor 102 are at the maximum opening degree, and the rotational speeds of the first compressor 101 and the second compressor 102 can be constantly adjusted according to the demand.

After the expected current mode of the refrigeration system has been determined in step 701, the method proceeds to step 702 to determine whether the expected current mode is the hot gas bypass operating mode, the PRV operating mode, or the speed operating mode. For the three different operating mode designs, the load balance monitoring system 100 has three different balance determination and control logics.

If a determination result in step 702 is the hot gas bypass operating mode, the method returns to step 702 to re-determine the expected current mode of the refrigeration system, so as to re-enter the control logic 700 for determining the balance of compressors without proceeding to the subsequent balance determination logic. This is because, in the hot gas bypass operating mode, the top of the evaporator 103 and the top of the condenser 104 are in direct communication with each other through the hot gas bypass pipeline 125, and at this moment, the air flow inside the refrigeration system is turbulent. As a result, it is impossible to determine whether the two compressors are balanced by monitoring the flow rates at the exhaust sides of the compressors, and therefore, there is no need to proceed to the subsequent logic for determining the balance of compressors. In addition, since the duration of the hot gas bypass operating mode is typically short, no major impact on the overall operating situation of the refrigeration system even no determination of the balance of two compressors is conducted in this mode.

If a determination result in step 702 is the PRV operating mode, the method returns to step 703. In step 703, the processor 602 of the control device 600 obtains the gas flow rate $Q_C$ at the exhaust side 111 of the first compressor 101 and the gas flow rate $Q_D$ at the exhaust side 111 of the second compressor 102 from the input interface 603 via the bus 601. After step 703 is completed, the control device 600 turns the operation to step 704. In step 704, the processor 602 calculates the flow rate deviation percent $\delta Q=2\times|Q_C-Q_D|/(Q_C+Q_D)$ according to the obtained gas flow rates $Q_C$ and $Q_D$. Subsequently, the method proceeds to step 705.

In step 705, the processor 602 determines whether the flow rate deviation percent $\delta Q$ is greater than or equal to a first preset value. If no, that is, the flow rate deviation percent $\delta Q$ is smaller than the first preset value, the processor preliminarily determines that the first compressor and the second compressor are in a balanced state, and at this moment, the processor 602 returns the operation to step 701 to re-enter the control logic 700 for determining the balance of compressors. If yes, that is, the deviation percent $\delta Q$ is greater than or equal to the first preset value, the processor preliminarily determines that the first compressor and the second compressor are in an unbalanced state and enters step 706, so as to further confirm whether the two compressors are balanced. In the present embodiment, the first preset value is 3%, and in other embodiments, the first preset value may also be other values, for example, any value between 2% and 5%.

In step 706, the processor 602 starts timing so as to continuously obtain the gas flow rate $Q_C$ at the exhaust side of the first compressor and the gas flow rate $Q_D$ at the exhaust side of the second compressor within a first preset time, continuously calculate the flow rate deviation percent $\delta Q$ according to the obtained gas flow rates $Q_C$ and $Q_D$, and determine whether the flow rate deviation percent $\delta Q$ is maintained above the first preset value during the first preset time. If a situation occurs during the first preset time that the constantly updated flow rate deviation percent $\delta Q$ is smaller than the first preset value, it is determined that the first compressor 101 and the second compressor 102 are in a balanced state, and the method returns to step 701 to re-enter the control logic 700 for determining the balance of compressors. If the flow rate deviation percent $\delta Q$ constantly updated during the first preset time is always maintained above the first preset value, it is further determined that the first compressor 101 and the second compressor 102 are in an unbalanced state, so as to enter the subsequent leveling and observing step. In the present embodiment, the first preset time is 5 min, and in other embodiments, the first preset time may also be other values, for example, any value between 2 min and 10 min.

After determining that the two compressors are in an unbalanced state in step 706, the control device 600 turns the steps to step 707, so as to carry out the subsequent leveling and observing step. In the PRV operating mode, the opening degrees of the pre-rotation vanes at the exhaust sides of the compressors are in a dynamic adjustment state. Therefore, to prevent misjudgment as a result of the opening degree adjustment by the PRVs of the compressors themselves, the opening degrees of the two compressors need to be re-adjusted after it is determined in step 706 that the two compressors are in an unbalanced state, so as to determine whether the adjusted two compressors are still in an unbalanced state. If they are still in an unbalanced state, it is ultimately determined that the two compressors are in an unbalanced state. In step 707, the processor 602 compares the gas flow rate $Q_C$ at the exhaust side of the first compressor and the gas flow rate $Q_D$ at the exhaust side of the second compressor that are obtained previously. If the processor 602 determines that $Q_C$ is smaller than $Q_D$, the operation is turned to step 708, so as to increase the opening degree of the pre-rotation guide vane 105 of the first compressor 101; and if $Q_C$ is greater than $Q_D$, the operation is turned to step 709, so as to increase the opening degree of the pre-rotation guide vane 105 at the exhaust side of the second compressor 102. In step 708 and step 709, the opening degrees of the pre-rotation guide vanes 105 of the first compressor 101 and the second compressor 102 are both adjusted by the flow rate deviation percent $\delta Q$ obtained previously. After obtaining an opening degree compensation being equal to the percent of $\delta Q$, the opening degree of the pre-rotation guide vane 105 of the compressor with the lower exhaust flow rate would be easier to obtain an exhaust flow rate that is the same as that of the compressor with the higher exhaust flow, thereby achieving the correction of the unbalanced state of the compressors. It is easy for the compressor with the lower exhaust flow rate to experience surge. Therefore, to avoid safety issues in the refrigeration system caused by the compressor surge, the control device 600 always increases the pre-rotation guide vane 10 of the compressor corresponding to the lower exhaust flow rate, while decreases the opening degree of the pre-rotation guide vane of the compressor with the higher exhaust flow rate. To realize the adjustments of the pre-rotation guide vanes 105, the processor 602 transmits a control signal to the output interface 604 via the bus 601, and the control signal is transmitted, via the output line 614, to the pre-rotation guide vanes 105 of a compressor in need of adjustments (that is, the compressor with the lower exhaust flow rate), such that the pre-rotation guide vanes 105 that receives the signal can increase its opening degree according to the δQ percent.

After step 708 or step 709, the control device 600 turns the operation to step 710. In step 710, the processor 602 starts timing, and when the timing reaches a second preset time, the control device 600 turns the operation to step 711. In step 711, the processor 602 re-obtains the gas flow rate $Q_C$ at the exhaust side of the first compressor and the gas flow rate $Q_D$ at the exhaust side of the second compressor from the input interface 603 via the bus 601. After step 711 is completed, the control device 600 turns the operation to step 712. In step 712, the processor 602 re-calculates the flow rate deviation percent δQ according to the re-obtained gas flow rates $Q_C$ and $Q_D$. Subsequently, the control device 600 turns the operation to step 713. In step 713, the processor 602 determines whether the re-calculated flow rate deviation percent δQ is greater than or equal to a second preset value. If yes, it indicates that the two compressors are still in an unbalanced state after the compensation and adjustment in step 708 or step 709, and at this moment, it is ultimately confirmed that the two compressors are unbalanced, and step 720 is carried out to perform the shutdown operation. In step 720, the processor 602 transmits a control signal for shutdown to the output interface 604 via the bus 601, and the control signal is transmitted, via the output line 614, to the driving device 107, such that the driving device 107 that receives the control signal performs the shutdown operation. If it is determined in step 713 that the re-calculated flow rate deviation percent δQ is smaller than the second preset value, it indicates that the two compressors are in a balanced state after the compensation and adjustment in step 708 or step 709. In the present embodiment, the second preset value is 15%, and in other embodiments, the second preset value may also be other values, for example, any value between 10% and 25%. By comparison with the first preset value in step 705, it can be seen that the second preset value is greater than the first preset value. This is because the first preset value is a parameter used to preliminarily determine whether two compressors are balanced and plays an early warning role, while the second preset value is a parameter used to ultimately determine whether two compressors are balanced and plays a role of determination.

In the operating mode determination in step 702, if the determination result is the speed operating mode, the control device 600 turns the operation to step 714 and step 715 sequentially. Step 714 is the same as step 703 in the PRV operating mode, where the processor 602 obtains the gas flow rate $Q_C$ at the exhaust side of the first compressor and the gas flow rate $Q_D$ at the exhaust side of the second compressor from the input interface 603 via the bus 601. Step 715 is the same as step 704 in the PRV operating mode, where the processor 602 calculates the flow rate deviation percent $\delta Q=2\times|Q_C-Q_D|/(Q_C+Q_D)$ according to the obtained gas flow rates $Q_C$ and $Q_D$.

After step 714 and step 715 are completed sequentially, the control device 600 turns the operation to step 716. In step 716, the processor 602 determines whether the calculated flow rate deviation percent δQ is greater than or equal to a third preset value. If no, that is, δQ is smaller than the third preset value, it is determined that the first compressor 101 and the second compressor 102 are in a balanced state, and at this moment, the processor 602 returns the operation to step 701 to re-enter the control logic 700 for determining the balance of compressors. If yes, that is, δQ is greater than or equal to the third preset value, it is determined that the first compressor 101 and the second compressor 102 are in an unbalanced state, and at this moment, the processor 602 returns the operation to step 717. In step 717, the processor 602 obtains a corresponding shutdown time t according to the calculated flow rate deviation value δQ, and then turns to step 718. In step 718, the processor 602 starts timing, and when the timing reaches the shutdown time t, the processor 602 turns the operation to step 720 to control the driving device 107 to stop the operation.

Figure 7B:
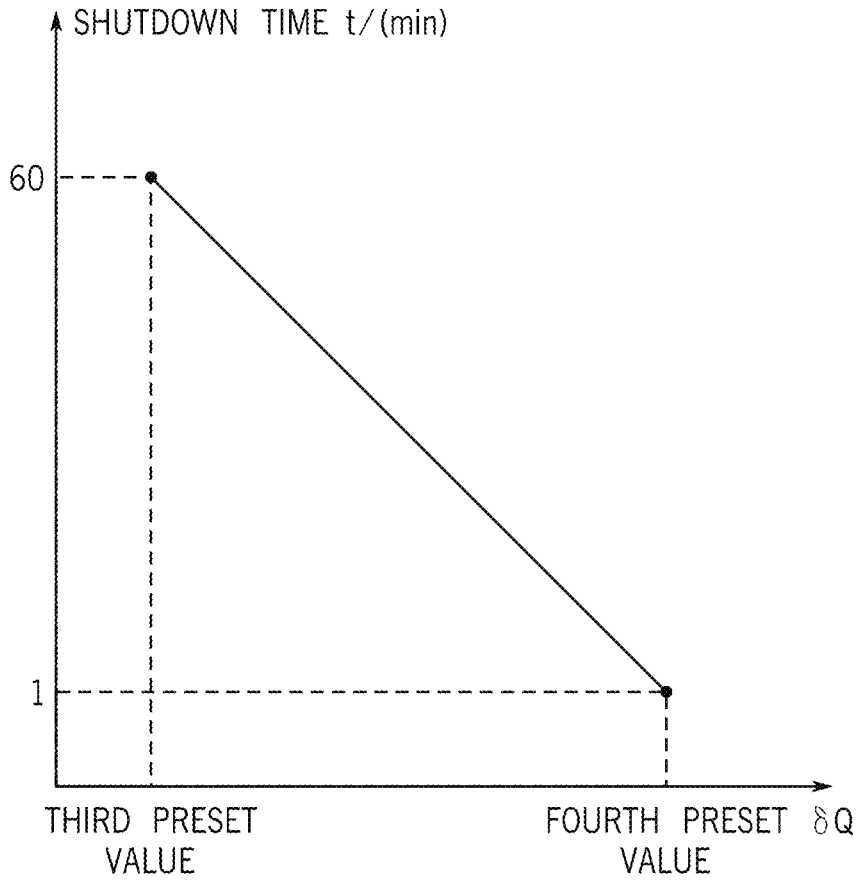
FIG. 7B illustrates a proportional relation between a shutdown time t and a flow rate deviation percent δQ when the flow rate deviation percent δQ is between a third preset value and a fourth preset value in step 717 shown in FIG. 7A.

FIG. 7B illustrates a proportional relation between the shutdown time t and the flow rate deviation percent δQ when the flow rate deviation percent δQ is between the third preset value and a fourth preset value. In the present embodiment, the shutdown time t is simultaneously associated with the third preset value and the fourth preset value, wherein the third preset value is smaller than the fourth preset value. When the flow rate deviation percent δQ is the third preset value, the shutdown time t is 60 min; and when the flow rate deviation percent δQ is the fourth preset value, the shutdown time t is 1 min. When the flow rate deviation percent δQ is between the third preset value and the fourth preset value, as shown in FIG. 7B, the shutdown time t is proportional to the flow rate deviation percent δQ and is between 1 min and 60 min. When the flow rate deviation percent δQ is greater than the fourth preset value, the shutdown time t is constant and is the shutdown time of 1 min corresponding to the fourth preset value as shown in FIG. 7B. In an embodiment, the third preset value is 10%, and the fourth preset value is 50%. In other embodiments, the third preset value and the fourth preset value may also be other values, for example, the third preset value is any value between 7% and 15%, and the fourth preset value is any value between 40% and 60%. In some other embodiments, other proper proportional relations may also be selected for the shutdown time t.

To accurately determine the shutdown time in cooperation with real-time changes of the flow rate deviation, the present application may also make improvements to the above embodiments. In an improved embodiment, in the process of waiting for the shutdown time t in step 718, the processor 602 also continuously obtains, from the input interface 603, the gas flow rate $Q_C$ at the exhaust side of the first compressor and the gas flow rate $Q_D$ at the exhaust side of the second compressor that correspond to δQ, and calculates and updates the flow rate deviation percent δQ according to the flow rates $Q_C$ and $Q_D$. When the current actual δQ obtained through continuous update and calculation is greater than the δQ value first obtained in step 715, the processor 602 obtains time Δt that has been waited after the timing starts in step 718, re-starts timing, and re-obtains a shutdown time t'. When the re-started timing reaches the re-obtained shutdown time t', the processor 602 turns the operation to step 720 to control the driving device 107 for shutdown. Here, the re-obtained shutdown time $t'=(t-\Delta t)\times$(current actual δQ/(the fourth preset value−the third preset value)).

Figure 8:
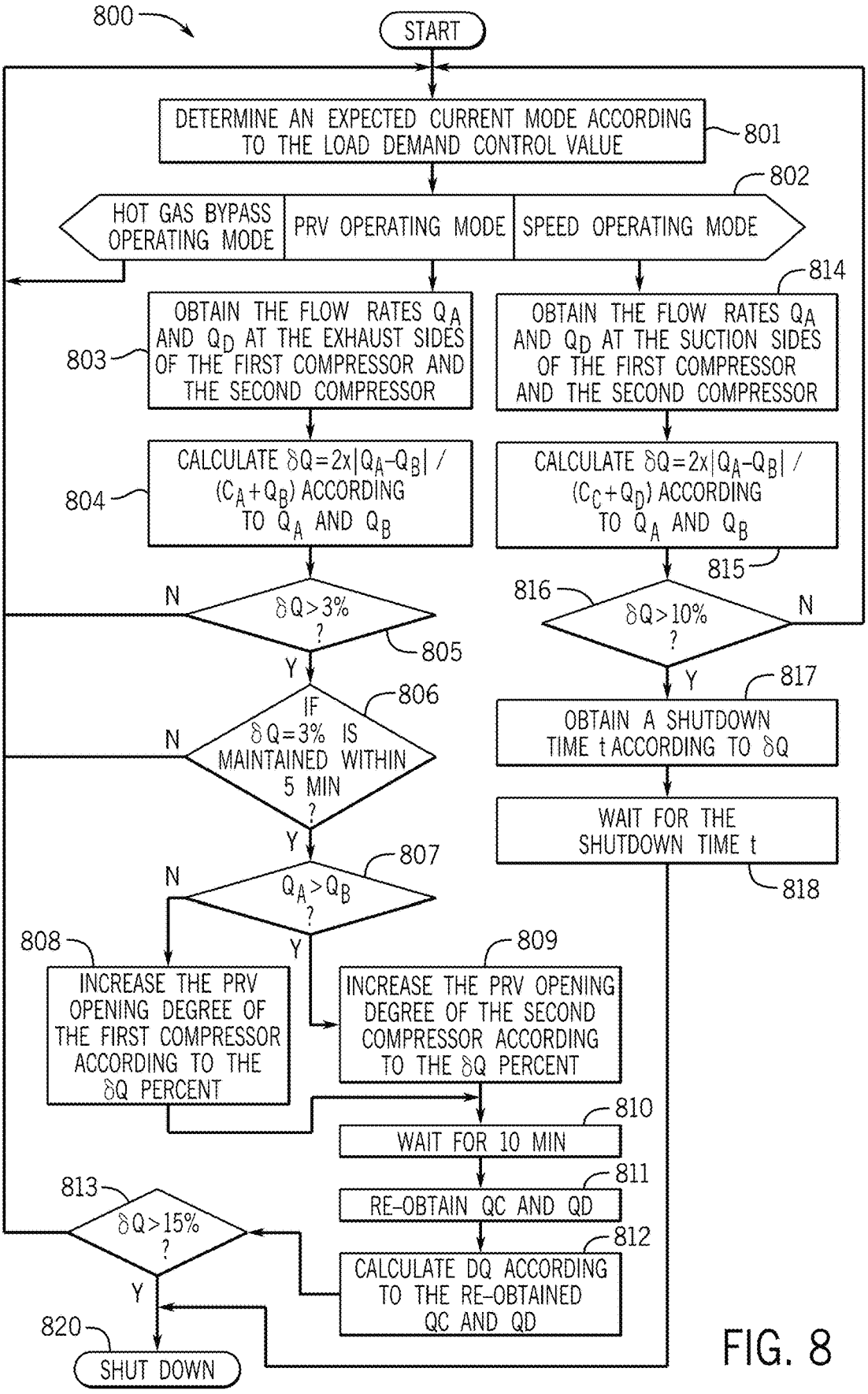
FIG. 8 illustrates a control logic 800 that adopts the load balance monitoring system 200 shown in FIG. 2 to monitor whether two coaxial compressors have balanced loads.

FIG. 8 illustrates a control logic that adopts the load balance monitoring system 200 in the second embodiment shown in FIG. 2 to monitor whether two coaxial compressors have balanced loads. The load balance monitoring system 200 determines whether the two compressors have balanced loads by monitoring the flow rates at the suction sides. When the load balance monitoring system 200 is running, the first suction flow sensor 203 and the second suction flow sensor 204 shown in FIG. 2 continuously monitor the gas flow rates $Q_A$ and $Q_B$ at the suction sides 110 of the first compressor 101 and the second compressor 102, and the measured gas flow rate data is transmitted, via the input line 613, to the input interface 603 in the control device 600. The control logic 800 of the load balance monitoring system 200 differs from the control logic 700 of the load balance monitoring system 100 shown in FIG. 7A only in that the control logic 800 replaces the gas flow rate $Q_C$ at the exhaust side of the first compressor in the control logic 700 in all cases with the gas flow rate $Q_A$ at the suction side of the first compressor, and replaces the gas flow rate $Q_D$ at the exhaust side of the second compressor in the control logic 700 in all cases with the gas flow rate $Q_B$ at the suction side of the second compressor. Corresponding to the flow rate deviation percent $\delta Q=2\times|Q_C-Q_D|/(Q_C+Q_D)$ in the control logic 700, the equation to calculate the flow rate deviation percent $\delta Q$ in the control logic 800 is $\delta Q=2\times|Q_A-Q_B|/(Q_A+Q_B)$. The average value of the gas flow rate $Q_C$ at the exhaust side of the first compressor and the gas flow rate $Q_D$ at the exhaust side of the second compressor is reported as $Q_{CD}$, and the average value of the gas flow rate $Q_A$ at the suction side of the first compressor and the gas flow rate $Q_B$ at the suction side of the second compressor is reported as $Q_{AB}$. Then, $Q_{CD}=(Q_C+Q_D)/2$, $Q_{AB}=(Q_A+Q_B)/2$, the flow rate deviation percent $\delta Q=|Q_C-Q_D|/Q_{CD}$ in the control logic 700, and the flow rate deviation percent $\delta Q=|Q_A-Q_B|/Q_{AB}$ in the control logic 800. It can be seen that, for the flow rate deviation percent $\delta Q$ in both embodiments, the deviation calculation is conducted with respect to the average value of gas flow rates at a corresponding side of the compressors. Since the flow rate deviation percent $\delta Q$ at the suction sides is substantially the same as the flow rate deviation percent $\delta Q$ at the exhaust sides, various parameters, such as multiple preset values, preset times, and shutdown times, used in the control logic 800 and the control logic 700 may have completely the same ranges of assigned values and calculation equations.

Figure 9:
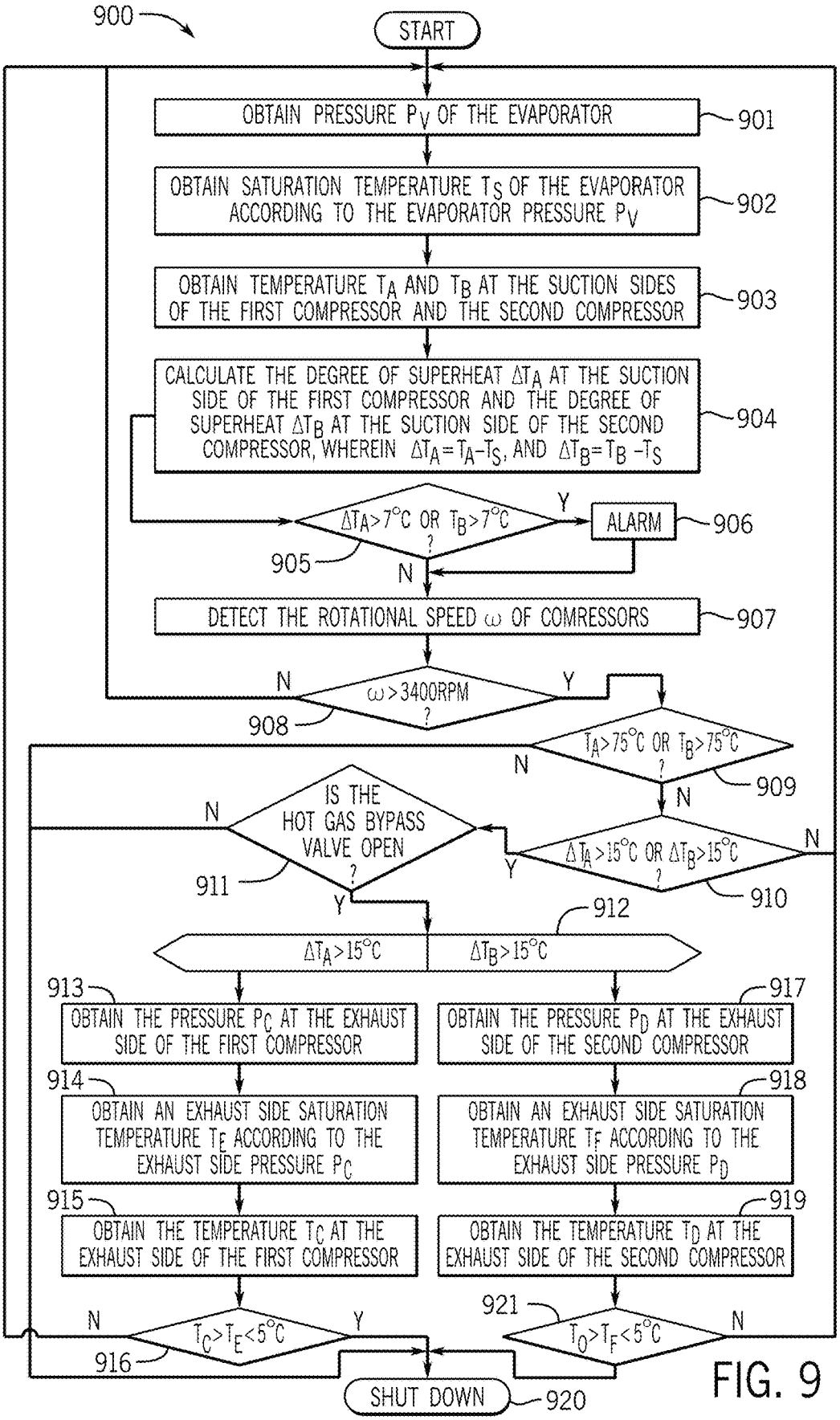
FIG. 9 illustrates a control logic 900 that adopts the load balance monitoring system 300 shown in FIG. 3 to monitor whether two coaxial compressors have balanced loads.

FIG. 9 illustrates a control logic 900 that adopts the load balance monitoring system 300 in the third embodiment shown in FIG. 3 to monitor whether two coaxial compressors have balanced loads. When the load balance monitoring system 300 is running, the first suction temperature sensor 301 and the second suction temperature sensor 302 in FIG. 3 respectively and continuously monitor the temperature $T_A$ at the suction side of the first compressor and the temperature $T_B$ at the suction side of the second compressor, the suction pressure sensor 307 continuously monitors the pressure inside the evaporator 103, the first exhaust temperature sensor 303 and the second exhaust temperature sensor 304 respectively and continuously monitor the temperature $T_C$ at the exhaust side of the first compressor and the temperature $T_D$ at the exhaust side of the second compressor, the first exhaust pressure sensor 305 and the second exhaust pressure sensor 306 respectively and continuously monitor the pressure $P_C$ at the exhaust side of the first compressor and the pressure $P_D$ at the exhaust side of the second compressor, the rotational speed sensor 310 continuously monitors the rotational speed of the driving device 107, and the measured temperature, pressure, and rotational speed data is transmitted, via the input line 613, to the input interface 603 in the control device 600.

As shown in FIG. 9, the control logic 900 of the load balance monitoring system 300 starts and then enters step 901. In step 901, the processor 602 of the control device 600 receives, from the input interface 603 via the bus 601, the evaporator pressure Pv from the suction pressure sensor 307. Subsequently, the processor 602 turns the operation to step 902. In step 902, the processor 602 obtains the corresponding saturation temperature $T_S$ of the evaporator according to the evaporator pressure Pv. After obtaining the corresponding saturation temperature $T_S$ of the evaporator in step 902, the processor 602 turns the operation to step 903. In step 903, the processor 602 receives, from the input interface 603 via the bus 601, the temperature $T_A$ at the suction side of the first compressor and the temperature $T_B$ at the suction side of the second compressor from the first suction temperature sensor 301 and the second suction temperature sensor 302. Subsequently, the processor 602 turns the operation to step 904. In step 904, the processor 602 calculates the degree of superheat $\Delta T_A$ at the suction side of the first compressor and the degree of superheat $\Delta T_B$ at the suction side of the second compressor according to the obtained temperature $T_A$ at the suction side of the first compressor, temperature $T_B$ at the suction side of the second compressor, and the saturation temperature $T_S$ of the evaporator, wherein $\Delta T_A=T_A-T_S$, and $\Delta T_B=T_B-T_S$.

After step 904 is completed, the processor 602 turns the operation to step 905. In step 905, the processor 602 determines whether $\Delta T_A$ and $\Delta T_B$ that are obtained from the calculation have a value greater than an early warning temperature. If yes, the processor 602 turns the operation to step 906 for carrying out an alarm operation; if no, the processor 602 turns the operation directly to step 907. In combination with FIG. 6, it can be seen that, in step 906, the processor 602 sends an alarm signal to the output interface 604 via the bus 601, the alarm signal is transmitted to an alarm device (not shown) via the output line 614, and upon receiving the signal, the alarm device sends an alarm to an operator. After the alarm operation in step 906 is completed, the processor 602 still turns the operation to step 907. In other words, the early warning determination in step 905 and the alarm operation in step 907 are only used to remind the operator of the refrigeration system to pay attention that the compressors may currently be in an unbalanced load state. In other embodiments, step 905 and step 906 may be not carried out. Instead, the processor 602 may turn the operation directly to step 907 after step 904. In the embodiments of the present application, the early warning temperature is 7° C., and in some other embodiments, the early warning temperature may also be other values.

In step 907, the processor 602 receives from the input interface 603 the rotational speed w from the driving device 107. Subsequently, the processor 602 turns the operation to step 908. In step 908, the processor 602 determines whether the obtained rotational speed w is greater than or equal to a predetermined rotational speed, wherein the predetermined rotational speed is the minimum rotational speed at which a compressor can start a normal operating state. If no, that is, w is slower than the predetermined rotational speed, the processor 602 returns the operation to step 901 to re-enter the determination procedure of the control logic 900; if yes, that is, w is greater than or equal to the predetermined rotational speed, the processor 602 turns the operation to step 909. When the rotational speed w of the driving device 107 is slower than the predetermined rotational speed, the compressor has not started a normal operating state, and at this moment, there is no need to perform the subsequent balance determining control logic 900. Only when the two compressors meet the minimum rotational speed for normal operations, is it necessary to perform the subsequent balance determination. In the present embodiment, the predetermined rotational speed is 3,400 rpm, and in other embodiments, the predetermined rotational speed may also be other values according to the operating state of the refrigeration system, such as any value between 3,200 rpm and 3,800 rpm.

In step 909, the processor 602 determines whether the suction temperature $T_A$ of the first compressor and the suction temperature $T_B$ of the second compressor obtained in step 903 have a value greater than a first preset temperature. If yes, that is, any value in the values of $T_A$ and $T_B$ is greater than the first preset temperature, it is determined that the two compressors are in an unbalanced state, and at this moment, the processor 602 turns the operation to step 920 to carry out a shutdown operation. If no, that is, all the values of $T_A$ and $T_B$ are smaller than or equal to the first preset temperature, it is preliminarily determined that the two compressors are in a balanced state, and at this moment, the processor 602 turns the operation to step 910. When the two compressors are in an unbalanced state, that is, at least one compressor is not in the normal operating state, the high ambient temperature from the condenser 104 is transferred to the suction side 110 through the exhaust side 111 of the abnormally operating compressor. At this moment, the suction side 110 of the abnormally operating compressor is in a state with overly high temperature. Therefore, when a high suction temperature appears at the suction side 110 of a compressor, it can be determined that the two compressors are in an unbalanced state. In the present embodiment, the first preset temperature is 75° C., and in other embodiments, the first preset temperature may also be other values, such as any value between 70° C. and 80° C. The parameter of the first preset temperature value is typically set to be a high temperature value, it is necessary to enter the subsequent control logic to perform further balance determination even if it is preliminarily determined that the two compressors are in a balanced state in step 909.

In step 910, the processor 602 determines whether a temperature greater than a second preset temperature occurs according to the degrees of superheat $\Delta T_A$ and $\Delta T_B$ at the suction sides of the first compressor and the second compressor obtained in step 904. If no, that is, the values of the two are all smaller than or equal to the second preset temperature, it is determined that the two compressors are in a balanced state, and at this moment, the processor 602 returns the operation to step 901 to re-enter the control logic 900 for balance determination. If yes, that is, any value in the values of the two is greater than the second preset value, the processor 602 turns the operation to step 911 at this moment. In the present embodiment, the second preset temperature is 15° C., and in other embodiments, the second preset temperature may also be other values, such as any value between 10° C. and 20° C. In the embodiments of the present application, the value of the second preset temperature is greater than the value of the early warning temperature.

In step 911, the processor 602 transmits a signal to the output interface 604 via the bus 601, the signal is transmitted, via the output line 614, to the hot gas bypass valve 106, and upon receiving the signal, the hot gas bypass valve 106 transmits a signal regarding the open/close situation of the hot gas bypass valve 106 to the input interface 603 via the input line 613. Upon receiving the signal, the input interface 603 transmits the signal to the processor 602 via the bus 601, and the processor 602 determines whether the hot gas bypass valve 106 of the current refrigeration system is open. If no, the hot gas bypass valve 106 is in a closed state, and the processor 602 turns the operation to step 920 to carry out a shutdown operation. If yes, the processor 602 turns the operation to step 912 to further confirm whether the two compressors are unbalanced. The top of the condenser 104 and the top of the evaporator 103 are in communication with each other through the hot gas bypass pipeline 125. Therefore, if the hot gas bypass valve 106 is in an open state, the high-temperature gas from the condenser 104 directly flows to the top of the evaporator 103, and the high-temperature gas flowing into the top of the evaporator 103 then flows to the suction sides 110 of the first compressor 101 and the second compressor 102, causing the suction sides 110 of the compressors to have a high temperature. In other words, when the hot gas bypass valve 106 closes the hot gas bypass pipeline 125, it can be determined that the two compressors are in an unbalanced state only according to the high temperature condition at the suction side 110 of a compressor. Under the condition that the hot gas bypass pipeline 125 is in communication, however, the high temperature condition may occur at the suction side 110 of a compressor even if the two compressors are in a balanced state. Therefore, when the hot gas bypass valve 106 is open, the two compressors cannot be determined to be in an unbalanced state only according to the condition that high temperature occurs at the suction side 110 of a compressor. It is necessary to further determine the degree of superheat at the exhaust side 111 of a corresponding compressor having the high temperature situation.

In step 912, the processor 602 determines, according to $\Delta T_A$ and $\Delta T_B$ obtained in step 904, whether the degree of superheat at the suction side corresponding to the first compressor 101 is greater than the second preset temperature or the degree of superheat at the suction side corresponding to the second compressor 102 is greater than the second preset temperature. If it is the degree of superheat at the suction side corresponding to the first compressor 101 that is greater than the second preset temperature, the processor 602 turns the operation to step 913. In step 913, the processor 602 receives, from the input interface 603 via the bus 601, the pressure $P_C$ at the exhaust side of the first compressor from the first exhaust pressure sensor 305. Subsequently, the processor 602 turns the operation to step 914. In step 914, the processor 602 obtains, according to the pressure $P_C$ at the exhaust side of the first compressor obtained in step 913, an exhaust side saturation temperature $T_E$ corresponding thereto. After obtaining the exhaust side saturation temperature $T_E$ of the first compressor 101, the processor 602 turns the operation to step 915. In step 915, the processor 602 obtains, from the input interface 603 via the bus 601, the temperature $T_C$ at the exhaust side of the first compressor from the first exhaust temperature sensor 303. Subsequently, the processor 602 turns the operation to step 916. In step 916, the processor 602 calculates the degree of superheat $\Delta T_C$ at the exhaust side of the first compressor, wherein $\Delta T_C = T_C - T_E$, and determines whether $\Delta T_C$ is lower than a third preset temperature. If yes, the processor 602 determines that the two compressors are in an unbalanced state, and turns the operation to step 920 to carry out a shutdown operation on the driving device 107; if no, the processor 602 determines that the two compressors are in a balanced state, and at this moment, the processor 602 turns the operation to step 901 to re-enter the control logic 900 for balance determination.

If it is the degree of superheat at the suction side corresponding to the second compressor 101 that is greater than the second preset temperature, the processor 602 turns the operation sequentially to steps 917, 918, 919, and 921, where steps 917, 918, 919, and 921 are respectively similar to steps 913, 914, 915, and 916. Step 917 is used to obtain the pressure $P_D$ at the exhaust side of the second compressor, step 918 is used to obtain the saturation temperature $T_F$ at the exhaust side of the second compressor according to the obtained $P_D$, and step 919 is used to obtain the temperature $T_D$ at the exhaust side of the second compressor. Step 921 is used to calculate the degree of superheat $\Delta T_D$ at the exhaust side of the second compressor according to $T_F$ obtained in step 918 and $T_D$ obtained in step 919, and determines, through the processor 602, whether $\Delta T_C$ is lower than the third preset temperature, wherein $\Delta T_D = T_D - T_F$. If yes, the processor 602 determines that the two compressors are in an unbalanced state, and enters step 920 to carry out a shutdown operation on the driving device 107; if no, the processor 602 determines that the two compressors are in a balanced state, and returns to step 901 to re-enter the control logic 900 for balance determination. In other words, in the hot gas bypass mode, it can be determined that the two compressors are in an unbalanced state only when the degree of superheat at the suction side corresponding to a compressor being greater than the second preset temperature and the degree of superheat at the corresponding exhaust side of the same compressor being lower than the third preset temperature are simultaneously satisfied. In the present embodiment, the third preset temperature is 5° C., and in other embodiments, the third preset temperature may also be other values, such as any value between 3° C. and 10° C.

The load balance monitoring system 100 according to the first embodiment as shown in FIG. 1 adopts the control logic 700 shown in FIG. 7A to determine whether two compressors are balanced by detecting the flow rates of the refrigerant at the exhaust sides 111 of the two compressors. The load balance monitoring system 200 according to the second embodiment as shown in FIG. 2 adopts the control logic 800 shown in FIG. 8 to determine whether two compressors are balanced by detecting the flow rates of the refrigerant at the suction sides 110 of the two compressors. The load balance monitoring system 300 according to the third embodiment as shown in FIG. 3 adopts the control logic 900 shown in FIG. 9 to determine whether two compressors are balanced by cooperatively detecting the degrees of superheat at the suction sides 110 and the degrees of superheat at the exhaust sides 111 of the two compressors.

The load balance monitoring system 400 as shown in FIG. 4 not only encompasses the monitoring equipment of the load balance monitoring system 100 in FIG. 1, but also encompasses the monitoring equipment of the load balance monitoring system 300 in FIG. 3. In other words, the load balance monitoring system 400 can either adopt the control logic 700 shown in FIG. 7A to determine whether two compressors are balanced by detecting the flow rates of the refrigerant at the exhaust sides 111 of the two compressors or adopt the control logic 900 shown in FIG. 9 to determine whether two compressors are balanced by detecting the degrees of superheat at the suction sides 110, in cooperation with detecting the degrees of superheat at the exhaust sides 111, of the two compressors. In some embodiments, the load balance monitoring system 400 adopts either of the control logic 700 and the control logic 900 to determine whether two compressors are balanced. In some other embodiments, the load balance monitoring system 400 simultaneously adopts two schemes, exhaust side flow rate monitoring and suction side temperature monitoring, to determine whether two compressors are balanced. When the load balance monitoring system 400 is running, the control device 600 simultaneously runs the control logic 700 and the control logic 900, and when a step of controlling the driving device 107 to shut down appears in any one thereof, it is determined that the two compressors are unbalanced. At this moment, the control logic 700 and the control logic 900 both stop running.

Similar to the load balance monitoring system 400 as shown in FIG. 4, the load balance monitoring system 500 as shown in FIG. 5 not only encompasses the monitoring equipment of the load balance monitoring system 200 in FIG. 2, but also encompasses the monitoring equipment of the load balance monitoring system 300 in FIG. 3. In other words, the load balance monitoring system 500 can either adopt the control logic 800 shown in FIG. 8 to determine whether two compressors are balanced by detecting the flow rates of the refrigerant at the suction sides 110 of the two compressors or adopt the control logic 900 shown in FIG. 9 to determine whether two compressors are balanced by detecting the degrees of superheat at the suction sides 110, in cooperation with detecting the degrees of superheat at the exhaust sides 111, of the two compressors. In some embodiments, the load balance monitoring system 500 adopts either of the control logic 800 and the control logic 900 to determine whether two compressors are balanced. In some other embodiments, the load balance monitoring system 500 simultaneously adopts two schemes, suction side flow rate monitoring and suction side temperature monitoring, to determine whether two compressors are balanced. When the load balance monitoring system 500 is running, the control device 600 simultaneously runs the control logic 800 and the control logic 900, and when a step of controlling the driving device 107 to shut down appears in any one thereof, it is determined that the two compressors are unbalanced. At this moment, the control logic 800 and the control logic 900 both stop running.

Only some features of the present application are illustrated and described herein, and a variety of improvements and variations may be made by those skilled in the art. Therefore, it should be understood that the appended claims intend to encompass all the above improvements and variations that fall within the scope of the essential spirit of the present application.

The invention claimed is:

1. A load balancing method for two compressors, the two compressors configured for use in a refrigeration system, comprising a first compressor and a second compressor, wherein the first compressor and the second compressor are configured to be driven coaxially by a same driving device, respective suction sides of the first compressor and the second compressor are each connected with a same evaporator via respective first pipelines, and respective exhaust sides of the first compressor and the second compressor are each connected with a same condenser via respective second pipelines, characterized in that the method comprises:

obtaining parameters, wherein the obtained parameters are related to the first compressor and the second compressor;

determining balance, comprising determining whether a balance is achieved between the first compressor and the second compressor according to the obtained parameters related to the first compressor and the second compressor; and controlling start/stop states, comprising controlling respective start/stop states of the first compressor and the second compressor according to whether the balance is achieved.

2. The method of claim 1, wherein:

the suction side of the first compressor and the suction side of the second compressor are each respectively provided with a pre-rotation guide vane, the pre-rotation guide vanes are configured to regulate a flow rate of a refrigerant flowing into the first compressor and the second compressor, and an imbalance between the first compressor and the second compressor is caused by the pre-rotation guide vanes.

3. The method of claim 2, further comprising:

obtaining an operating mode, wherein operating modes of the first compressor and the second compressor are obtained according to current load demands of the first compressor and the second compressor, the operating modes comprise a hot gas bypass operating mode, a speed operating mode, and a pre-rotation vane operating mode, and when the first compressor and the second compressor are running in the speed operating mode and the pre-rotation vane operating mode, the steps of determining balance and controlling start/stop states are carried out.

4. The method of claim 3, wherein:

the step of obtaining parameters comprises:

obtaining a flow rate $Q_A$ at the suction side of the first compressor and a flow rate $Q_B$ at the suction side of the second compressor; or obtaining a flow rate $Q_C$ at the exhaust side of the first compressor and a flow rate $Q_D$ at the exhaust side of the second compressor; and the step of determining balance comprises:

obtaining a flow rate deviation $\delta Q$ according to the flow rate $Q_A$ and the flow rate $Q_B$ or according to the flow rate $Q_C$ and the flow rate $Q_D$.

5. The method of claim 4, wherein the step of obtaining balance further comprises:

when the first compressor and the second compressor are running in the pre-rotation vane operating mode, determining whether the flow rate deviation $\delta Q$ is greater than or equal to a first preset value, and in response to a determination that the flow rate deviation $\delta Q$ is greater than or equal to a first preset value, preliminarily determining that the first compressor and the second compressor are in an unbalanced state.

6. The method of claim 5, wherein the step of obtaining balance further comprises:

after preliminarily determining that the first compressor and the second compressor are in the unbalanced state, continuously monitoring the flow rate $Q_A$ and the flow rate $Q_B$ or monitoring the flow rate $Q_C$ and the flow rate $Q_D$ within a first preset time, determining whether the flow rate deviation $\delta Q$ is continuously greater than or equal to the first preset value according to the flow rate $Q_A$ and the flow rate $Q_B$ or the flow rate $Q_C$ and the flow rate $Q_D$, and in response to a determination that the flow rate deviation $\delta Q$ is continuously greater than or equal to the first preset value, determining that the first compressor and the second compressor are in the unbalanced state.

7. The method of claim 6, wherein:

the method further comprises adjusting the two compressors, wherein the step of adjusting the two compressors comprises adjusting an opening degree of the pre-rotation guide vanes, and the step of adjusting the two compressors is carried out after determining that the first compressor and the second compressor are in the unbalanced state; and the step of controlling start/stop states comprises:

waiting for a second preset time after the step of adjusting the two compressors, re-obtaining the flow rate $Q_A$ and the flow rate $Q_B$ or re-obtaining the flow rate $Q_C$ and the flow rate $Q_D$ after the second preset time elapses, and determining an adjusted flow rate deviation $\delta Q$ according to the flow rate $Q_A$ and the flow rate $Q_B$ or according to the flow rate $Q_C$ and the flow rate $Q_D$; and determining whether the adjusted flow rate deviation $\delta Q$ is greater than or equal to a second preset value, and in response to a determination that the adjusted flow rate deviation $\delta Q$ is greater than or equal to the second preset value-if yes, shutting down the two compressors, wherein the second preset value is greater than the first preset value.

8. The method of claim 4, wherein:

the step of determining balance further comprises: when the first compressor and the second compressor are running in the speed operating mode, determining whether the flow rate deviation $\delta Q$ is greater than or equal to a third preset value, and in response to a determination that the flow rate deviation $\delta Q$ is greater than or equal to the third preset value, determining that the first compressor and the second compressor are in an unbalanced state; and the step of controlling start/stop states comprises: after determining that the first compressor and the second compressor are in the unbalanced state, obtaining a shutdown time according to the flow rate deviation $\delta Q$, and shutting down the two compressors when the shutdown time elapses.

9. The method of claim 4, wherein:

the flow rate $Q_A$ at the suction side of the first compressor is measured on a first bypass pipeline at one side of the respective first pipeline between the first compressor and the evaporator, and the flow rate $Q_B$ at the suction side of the second compressor is measured on a second bypass pipeline at one side of the respective first pipeline between the second compressor and the evaporator; or the flow rate $Q_C$ at the exhaust side of the first compressor is measured on a third bypass pipeline at one side of the respective second pipeline between the first compressor and the condenser, and the flow rate $Q_D$ at the exhaust side of the second compressor is measured on a fourth bypass pipeline at one side of the respective second pipeline between the second compressor and the condenser.

10. The method of claim 4, wherein the flow rate deviation $\delta Q=2|Q_A-Q_B|/(Q_A+Q_B)$, or the flow rate deviation $\delta Q=2|Q_C-Q_D|/(Q_C+Q_D)$.

11. The method of claim 1, wherein the step of obtaining parameters comprises:

obtaining a temperature $T_A$ at the suction side of the first compressor and a temperature $T_B$ at the suction side of the second compressor; and the step of determining balance comprises:

determining whether the temperature $T_A$ at the suction side of the first compressor or the temperature $T_B$ at the suction side of the second compressor is greater than a first preset temperature, and in response to a determination that the temperature $T_A$ or that the temperature $T_B$ is greater than the first preset temperature, carrying out the step of controlling start/stop states to shut down the first compressor and the second compressor.

12. The method of claim 11, wherein:

a top of the evaporator and a top of the condenser are in communication with each other through a hot gas bypass pipeline, and a hot gas bypass valve is provided in the hot gas bypass pipeline; and the step of determining balance further comprises:

in response to a determination that that neither the temperature $T_A$ at the suction side of the first compressor nor the temperature $T_B$ at the suction side of the second compressor is greater than the first preset temperature, obtaining a degree of superheat $\Delta T_A$ at the suction side of the first compressor and a degree of superheat $\Delta T_B$ at the suction side of the second compressor, and determining whether the degree of superheat $\Delta T_A$ at the suction side of the first compressor or the degree of superheat $\Delta T_B$ at the suction side of the second compressor is greater than a second preset temperature, and in response to a determination that the degree of superheat $\Delta T_A$ or that the degree of superheat $\Delta T_B$ is greater than the first preset temperature, determining whether the hot gas bypass valve is open;

in response to a determination that the hot gas bypass valve is open, determining whether the degree of superheat $\Delta T_A$ at the suction side of the first compressor is greater than the second preset temperature or the degree of superheat $\Delta T_B$ at the suction side of the second compressor that is greater than the second preset temperature;

in response to a determination that the degree of superheat $\Delta T_A$ at the suction side of the first compressor is greater than the second preset temperature, obtaining a degree of superheat $\Delta T_C$ at the exhaust side of the first compressor, and determining whether the degree of superheat $\Delta T_C$ at the exhaust side of the first compressor is lower than a third preset temperature, and in response to a determination that the degree of superheat $\Delta T_C$ is lower than the third preset temperature, carrying out the step of controlling start/stop states to shut down the first compressor and the second compressor;

in response to a determination that the degree of superheat $\Delta T_B$ at the suction side of the second compressor that is greater than the second preset temperature, obtaining a degree of superheat $\Delta T_D$ at the exhaust side of the second compressor, and determining whether the degree of superheat $\Delta T_D$ at the exhaust side of the second compressor is lower than the third preset temperature, and in response to a determination that the degree of superheat $\Delta T_D$ is lower than the third preset temperature, carrying out the step of controlling start/stop states to shut down the first compressor and the second compressor; and in response to a determination that the hot gas bypass valve is closed, carrying out the step of controlling start/stop states to shut down the first compressor and the second compressor.

13. The method of claim 11, wherein the step of determining balance further comprises:

determining whether rotational speeds of the first compressor and the second compressor are greater than a predetermined rotational speed, and carrying out, only when the rotational speeds of the first compressor and the second compressor are greater than the predetermined rotational speed, the step of determining whether the temperature $T_A$ at the suction side of the first compressor or the temperature $T_B$ at the suction side of the second compressor is greater than the first preset temperature.

14. The method of claim 12, wherein:

the degree of superheat $\Delta T_A$ at the suction side of the first compressor is a first temperature difference between the temperature $T_A$ at the suction side of the first compressor and a first saturation temperature of the evaporator; and the degree of superheat $\Delta T_B$ at the suction side of the second compressor is a second temperature difference between the temperature $T_B$ at the suction side of the second compressor and the first saturation temperature of the evaporator.

15. The method of claim 12, wherein:

the degree of superheat $\Delta T_C$ at the exhaust side of the first compressor is a third temperature difference between a temperature $T_C$ at the exhaust side of the first compressor and a second saturation temperature at the exhaust side of the first compressor; and the degree of superheat $\Delta T_D$ at the suction side of the second compressor is a fourth temperature difference between a temperature $T_D$ at the exhaust side of the second compressor and a third saturation temperature at the exhaust side of the second compressor.

* * * * *